US005896751A

United States Patent [19]

Wakizaka et al.

[11] Patent Number: 5,896,751

[45] Date of Patent: Apr. 27, 1999

[54] AIR CONDITIONER HAVING HUMIDIFYING FUNCTION

[75] Inventors: Eiji Wakizaka, Yao; Yoshiharu Shinobu, Kashihara; Hiroyuki Iida, Fujiidera; Miwa Kamii, Osaka; Michiaki Oshikane, Tondabayashi; Akira Ohtsuki, Nara; Takashi Kishimoto, Osaka, all of Japan

[73] Assignee: Sharp Kabushiki Kaisha, Osaka, Japan

[21] Appl. No.: 08/902,040

[22] Filed: Jul. 29, 1997

[30] Foreign Application Priority Data

| | | | |
|---|---|---|---|
| Jul. 30, 1996 | [JP] | Japan | 8-199473 |
| Jul. 31, 1996 | [JP] | Japan | 8-201455 |
| Aug. 23, 1996 | [JP] | Japan | 8-221947 |
| Aug. 30, 1996 | [JP] | Japan | 8-229584 |
| Sep. 9, 1996 | [JP] | Japan | 8-237454 |

[51] Int. Cl.[6] ..... F24F 6/02

[52] U.S. Cl. ..... 62/271; 62/93; 261/DIG. 15

[58] Field of Search ..... 62/91, 92, 94, 62/271, 298; 261/127, 146, 83, DIG. 15

[56] References Cited

U.S. PATENT DOCUMENTS

| | | | |
|---|---|---|---|
| 3,611,743 | 10/1971 | Manganaro | 62/298 |
| 4,474,021 | 10/1984 | Harband | 62/94 |

FOREIGN PATENT DOCUMENTS

| | | | |
|---|---|---|---|
| B2 62-48119 | 10/1987 | Japan . | |
| U 63-52028 | 4/1988 | Japan . | |
| A63-286634 | 11/1988 | Japan . | |
| 73531 | 3/1992 | Japan . | |
| A4-73531 | 3/1992 | Japan . | |
| A5-71753 | 3/1993 | Japan . | |
| 624069 | 9/1978 | U.S.S.R. | 62/271 |

*Primary Examiner*—William Doerrler

*Attorney, Agent, or Firm*—Birch, Stewart, Kolasch & Birch, LLP

[57] ABSTRACT

An air conditioner having an improved humidifying portion to humidify air in a room is provided. The humidifying portion includes a humidifying member having hygroscopicity and gas permeability, a first air flow passage for taking in air from the outdoors, passing the air through the humidifying member, allowing the humidifying member to absorb moisture included in the air for drying, and letting out the air outdoors, and a second air flow passage for taking in air from the room, passing the air through the humidifying member while heating the air, allowing the moisture absorbed by the humidifying member to evaporate and humidify the air and letting out the air into the room. Thus, only a single air intake opening for humidifying indoor air is necessary on the indoor side, the structure of the air conditioner can be simplified and compact, which makes easier the attachment. If the air conditioner is apart from the outdoors, outdoor air does not have to be taken in, the blowing load and the noise level can be reduced, and reduced power consumption is required compared to a conventional device.

12 Claims, 21 Drawing Sheets

AIR CONDITIONER HAVING HUMIDIFYING FUNCTION

BACKGROUND OF THE INVENTION

1. Field of the Invention

The present invention relates generally to air conditioners having a humidifying function, and more particularly, to an air conditioner having a humidifying function without the necessity of water supply for humidification.

2. Description of the Related Art

There have been air conditioners having a humidifying function without the necessity of water supply for humidification. Such an air conditioner employs a material having necessary hygroscopicity and gas permeability (hereinafter referred to as absorbent) for humidification. During humidification, moisture in the air is absorbed into an absorbent, then air warmed by a heater passes through the absorbent, and therefore the moisture desorbed from the absorbent is absorbed by the warmed air, which is supplied indoors as humidified air.

As such an air conditioner capable of humidifying air without the necessity of water supply, for example, Japanese Patent Laying-Open No. 63-286634 discloses a humidifier which takes in moisture from outdoor air and humidifies indoor air. FIG. 27 is a view showing the structure of the humidifier disclosed by Japanese Patent Laying-Open No. 63-286634. In the humidifier, outdoor air coming in from the inlet of a tube for passing outdoor air through the humidifier passes through and has its moisture absorbed by a solid absorbent 131 rotating around the axis of the tube, and is let outdoors from an outlet as dried air. Indoor air coming in from an inlet of a tube for passing indoor air through the humidifier is heated by a heater 132, absorbs moisture disorbed from solid absorbent 131 to be highly humid air as it passes therethrough, and is sent indoors as humidified air from the outlet. Note that solid absorbent 131 is driven to rotate by a driving motor 133.

As described above, in the humidifier shown in FIG. 27, outdoor and indoor air is taken into the humidifier, through separated and independent air flow passages, which impedes miniaturization of the device. Furthermore, if the humidifier is apart from the outdoors, there is a great loss in pressure by sending air for the purpose of suction/exhaustion of air from/to the outdoors, resulting in increase in the size and noise level of a blower member. There is known a conventional air conditioner which includes a ventilation duct connecting an outdoor unit and an indoor unit for the purpose of ventilation, dehumidification, and humidification without water supply as described above. FIGS. 28A and 28B show the configuration of the indoor unit of such a conventional air conditioner. FIGS. 28A and 28B show the indoor unit 121 of the air conditioner and a ventilation duct 122 letting in outdoor air into indoor unit 121. Note that when indoor unit 121 is installed, the ventilation duct, a refrigerant pipe, a drain pipe, and a power line pass through a side surface of indoor unit 121 as shown in FIG. 28A or via the upper or lower surface of outdoor unit 121, then through a through hole formed on a wall and connected to the outdoor unit which is not shown. FIGS. 29A–29D show in enlarged form the vicinity of ventilation duct 122 in FIGS. 28A and 28B. In FIG. 29A, in the vicinity of ventilation duct 122, there are provided a refrigerant pipe 125, a drain hose 126 to discharge outdoor drainage generated by a heat exchanger (not shown) in an indoors unit 121 shown in FIGS. 28A and 28B, and a power line 127 to supply electric power to the outdoor unit from the indoor unit 121.

When the indoor unit 121 is installed, an extension refrigerant pipe is usually used on the side of indoor unit 121, and the connecting portion of the refrigerant pipe on the side of outdoor unit and the extension refrigerant pipe is provided on the side of the indoor unit 121. The structure of the connecting portion is shown in FIGS. 29B and 29C. As shown, nuts are used for a connecting portion 124 connecting refrigerant pipe 125*a* on the outdoor unit side and refrigerant pipe 125*b* for extension, and the diameter of connecting portion 124 is larger than the diameter of refrigerant pipe 125 (125*a*, 125*b*). Connecting portion 124 is provided in the vicinity of ventilation duct 122 at a position opposite to ventilation duct 122. Refrigerant pipe 125 and connecting portion 124 have their surfaces wound with a heat insulating tape or covered with a cover for the indoor unit.

Note that as shown in FIG. 29D, some air conditioners have a ventilation duct 122, a refrigerant pipe 125, a drain pipe 126 and a power line 127 formed and accommodated integrally inside a pipe 123. In such a case, as is the above device, the connecting portion 124 of refrigerant pipe 125 has a large diameter and is positioned near ventilation duct 122.

As in the air conditioners shown in FIGS. 28A and 28B and 29A–29D, when a heat insulating tape is wound around refrigerant pipe 125 and connecting portion 124, stress is imposed on ventilation duct 122 which is near and opposite to connecting portion 124, and ventilation duct 122 is prone to damages. In order to avoid the damages, a space is secured between ventilation duct 122 and refrigerant pipe 125 for the expanded diameter of connecting portion 124 corresponding to the width of the nuts, and connecting portion 124 and ventilation duct 122 are kept from contact. Thus, a large dead space forms.

A conventional air conditioner capable of ventilation is disclosed by Japanese Patent Laying-Open No. 4-73531. FIG. 30 is a cross sectional view showing in the vicinity of the ventilation path of the disclosed air conditioner. FIGS. 31A and 31B are cross sectional views showing the ventilation path in FIG. 30. In FIG. 30, the air conditioner includes an indoor unit 114 on the indoor side of a wall 115 separating the indoor and outdoor. When indoor air is discharged outdoors from indoor unit 114, indoor air is taken into a duct 105 from indoor intake/exhaust opening 108 by the function of an outdoor blower 107, and is blown out from an outdoor intake/exhaust opening 109 through a sleeve 106. When outdoor air is taken indoors, outdoor air is taken into sleeve 106 from opening 109 by the function of blower 107, and blown out into the room from opening 108 through duct 105. Sleeve 106 is used to draw a refrigerant pipe 110, a drain hose 111, and a power line 116 from the indoors to the outdoors through wall 115, and there is a ventilation path 117 in sleeve 106.

Blower 107 for ventilation and duct 105 leading to the front side of indoor unit 114 communicate with sleeve 106 to form a ventilation path 117. A pipe bundle 112 including refrigerant pipe 110, drain hose 111 and power line 116 are integral in form in sleeve 106. A guide plate 113 is attached to pipe bundle 112 to secure ventilation path 117 in sleeve 106.

In such an air conditioner, refrigerant 110, drain hose 111 and power line 116 are bundled in sleeve 106 as pipe bundle 112, and the remaining space in sleeve 106 is used for ventilation path 117. Therefore, when refrigerant pipe 110, drain hose 111 and power line 116 are passed through a through hole for tubing provided in wall 115, sleeve 106 having the same diameter as the through hole cannot be easily inserted therethrough, and it takes much time to install the air conditioner as a result.

Conventionally, in order to accommodate and protect pipes such as a drain pipe for drainage water from the indoor unit of an air conditioner and a refrigerant pipe connecting the indoor and outdoor units, and an electric wire, tubing covers of resin or the like varied in shape and fashion are used. When the pipes and electrical wire passing through the through hole in the wall from the indoor unit are bent along the wall and attached to the outdoor unit, there is provided a corner tubing cover which connects to the linear shape tubing cover along the wall and the through hole and protects the bent portion of the pipes.

Such a corner tubing cover is disclosed by Japanese Patent Publication No. 62-48119. The disclosed cover connects to the through hole in the wall and another tubing cover along the wall surface to cover the expanded and bent portion of the pipes, and is separated into two portions for the ease of attachment.

Furthermore, Japanese Utility Model Laying-Open No. 63-52028 discloses a hood type weathertight cover which keeps wind and rain from coming into the room at the time of taking in/exhausting air. An indoor intake/exhaust fan is provided on the outdoor side of a duct to keep wind and rain from coming into the room, and the disclosed cover has an insect proof screen.

Furthermore, as disclosed by Japanese Patent Laying-Open No. 5-71753, there is provided a ventilation unit on the outdoor side of the through hole in the wall which is in cooperation with the air conditioner to allow a ventilation opening for distributing outdoor air, the inner space of a pipe for the through hole in the wall is partitioned into a path for the pipes and an intake/exhaust path for ventilation and an intake window is provided under the outdoor ventilation unit.

It is complicated to attach such a corner tubing cover for the bent portion of the pipes for difference in size between connecting portions when the use of another tubing cover having a different diameter along the wall is desired.

If the hood type weathertight cover is provided for the corner portion of the pipes, another opening for passing the tubing cover should be provided on a side surface of the weathertight cover in order to bend the pipes in any lateral orientation depending upon the condition of installing the outdoor unit.

Furthermore, simply providing an intake window under the ventilation unit cannot prevent wind, rain and insects from coming in through the opening.

SUMMARY OF THE INVENTION

It is an object of the invention to provide a high performance air conditioner having a humidifying function which is easy to be install.

In order to achieve the object, the air conditioner according to the invention has a humidifying portion to humidify air inside a room. The humidifying portion includes a humidifying member having hygroscopicity and permeability, a first air passage for taking in indoor air, passing the air through the humidifying member to allow moisture included therein to be absorbed by the humidifying member for drying, and exhausting the air outdoors, and a second air passage for taking in indoor air, heating and passing the air through the humidifying member to allow the moisture absorbed by the humidifying member to be evaporated for humidifying the air, and letting out the air indoors.

Only a single air intake opening for humidifying the indoor air is therefore necessary on the indoor side, and the air conditioner has a simpler and compact structure and can be easily installed. In addition, if the air conditioner is apart from the outdoors, the load for sending air is reduced, because outdoor air is not taken in. Therefore, the size and noise level of the device can be reduced, and power consumption is smaller than conventional cases.

The air conditioner as described above is adapted to operate only in the first air passage.

The air conditioner therefore functions as a ventilation device for the indoor and outdoor air. When indoor air is let outdoors, air equal in amount to the exhausted air is allowed to come into the room through natural ventilation, and therefore the indoor air can be effectively ventilated.

The air conditioner as described above may further include a driving portion to rotate the humidifying member, such that the absorption of moisture by the first air passage and the evaporation of the moisture by the second air passage are continuously performed.

As a result, a high performance air conditioner can be provided, by which indoor air can be stably humidified, because the absorption and evaporation of the moisture are continuously performed by the rotation of the humidifying member.

The air conditioner as described may further include a switching portion commonly provided to the first and second air passages for switchably letting out the air passed through the humidifying member alternatively to the indoors or outdoors.

Thus, the switching portion is provided commonly to the first and second air passages. The first and second air passages are shared up to the position after the passage of air through the humidifying member from the air intake opening from the indoors. Thus, the air conditioner may further be reduced in size and more easily installed.

The air conditioner as described above may further include in an integral form an accommodation portion for accommodating a humidifying member so as to allow the passage of air therethrough, and a member for transmitting a driving force to rotate the humidifying member from the driving portion.

The accommodation portion for accommodating the humidifying member and the driving force transmitting member to rotate the accommodation portion are integrally formed, and therefore the air conditioner can be further reduced in size and installed more easily. In addition, the driving force for rotation is surely transmitted to the accommodation portion, a better humidifying function is achieved.

The air conditioner as described above may further include an indoor unit including at least a humidifying member and first and second air passages, and an outdoor unit connected to the indoor unit through the wall by various pipes including a refrigerant pipe passed through a through hole formed in the wall and a duct for exchanging indoor air let out from the indoors with outdoor air. Particularly in this case, first and second pipe portions of the refrigerant pipe are coupled by a connecting member having a larger diameter than each pipe portion, and a contact protecting portion is formed on the surface of the duct facing the connecting member to prevent the connecting member from contacting the duct, if the duct is provided near the refrigerant pipe.

Therefore, damages of the duct caused by the contacting of the duct and the connecting portion of the refrigerant pipe can be prevented, which makes easier installment of various pipes including the refrigerant pipe.

The air conditioner as described above may further include an indoor unit including at least a humidifying member and first and second air passages, an outdoor unit connected to the indoor unit through the wall by various pipes passed through a through hole formed on the wall, and a duct having one end connected to the indoor unit to exchange indoor air let out from the indoor unit and outdoor air, and the other end inserted to the end of the through hole on the indoor side, the other end of the duct has a cross sectional shape in coincidence with the shape of the remaining region in a cross sectional region of the through hole after the various pipes are inserted.

Thus, the various pipes are fixed in the through hole by the duct, and an air flow pass using the ventilation duct can be secured. Therefore, the load associated with ventilation by the air conditioner can be alleviated, the noise is restricted, and a high performance is achieved.

The air conditioner as described above may further include an indoor unit including at least a humidifying member and first and second air passages, an outdoor unit provided separated from the indoor unit by a wall, various pipes passed through a through hole formed in the wall to connect the indoor unit and the outdoor unit, a ventilation path provided through the through hole so as to ventilate indoor air let out from the indoor unit and outdoor air, and a tubing cover encompassing various pipes and the ventilation path partitioned from each other at the end portion of the through hole on the outdoor side, and the tubing cover may be provided with a ventilation opening having a screen to prevent insects from coming in from the outdoors into the ventilation path in the vicinity of the air outlet/inlet of the ventilation path. Thus, when insects are prevented from coming indoors (into the indoor unit) from the ventilation path for ventilation of indoor and outdoor air, malfunctions due to incoming insects can be avoided.

The tubing cover as described above may include a weathertight cover which covers the ventilation opening in order to prevent rain or wind from coming into the ventilation path from the ventilation opening, and the weathertight cover may be attached to the tubing cover to direct air passed through the opening downwardly regardless of the direction in which the tubing cover is attached.

More specifically, regardless of the direction of attaching the tubing cover, in other words regardless of the orientation of pipes in the outdoors, air passed through the ventilation opening is conveniently made to flow downwardly. In addition, a comfortable indoor environment is achieved, because rain or wind can be prevented from coming in at the time of ventilating indoor and outdoor air.

The weathertight cover as described above has a ventilating portion at a position opposite to the downward direction, through which wind coming in from the downward direction passes.

The pressure of the wind coming into the ventilation path through the ventilation opening is relaxed, which avoids damages to the tubing cover. Noise caused by wind coming into the ventilation path can be restricted, and a high performance air conditioner can be provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

First to seventh embodiments of the invention will be now described in conjunction with the accompanying drawings.

First Embodiment

Figure 1:
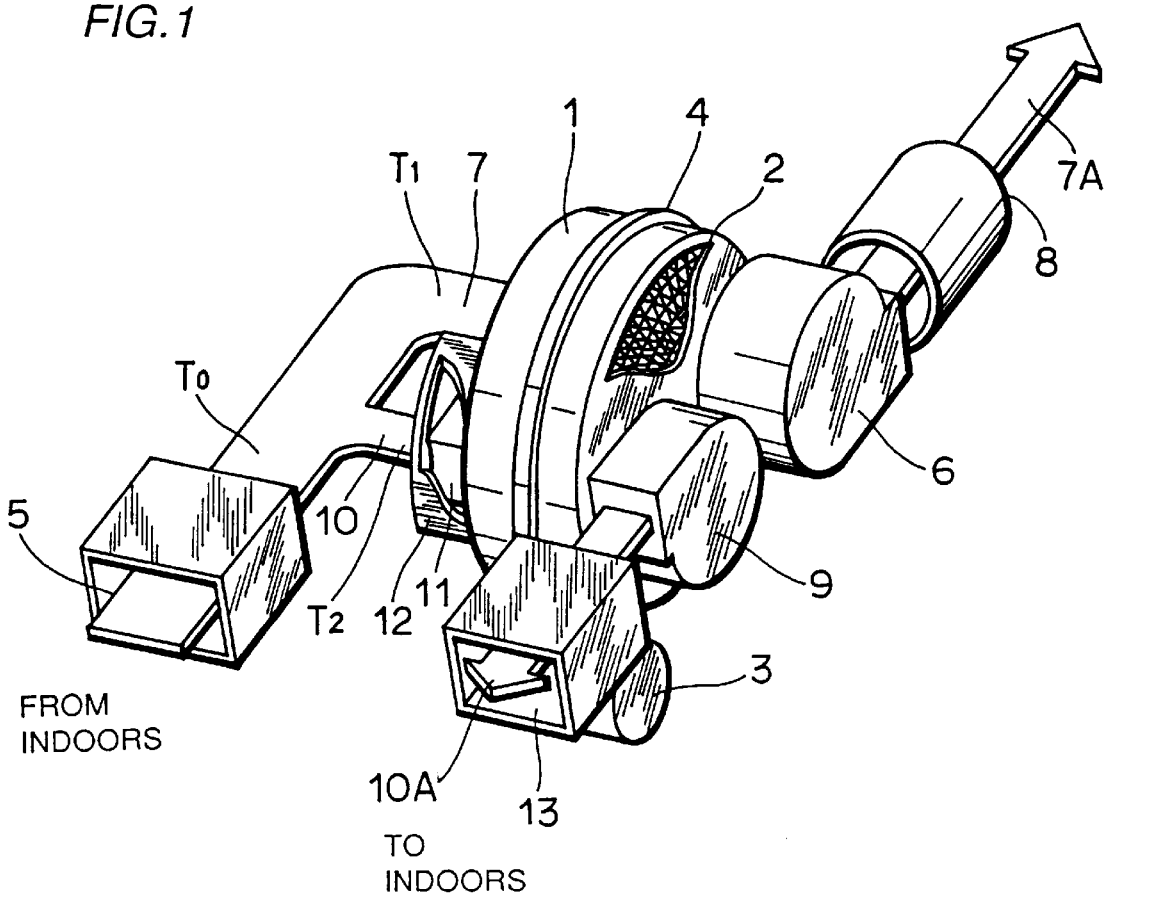
FIG. 1 is a view schematically showing the structure of a humidifier according to a first embodiment of the invention.
Figure 2:
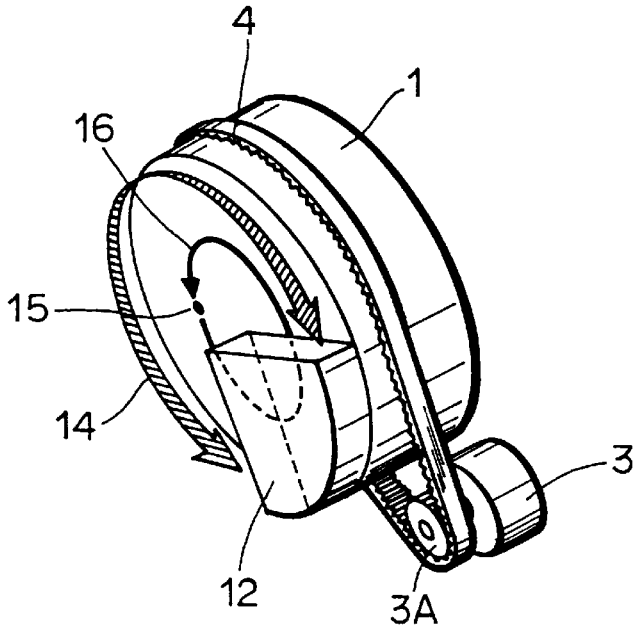
FIG. 2 is a perspective view showing a driving mechanism for a heat exchanger in the humidifier in FIG. 1.

FIG. 1 is a view schematically showing the structure of a humidifier according to a first embodiment of the invention, and FIG. 2 is a view for use in illustration of a driving mechanism for a heat exchanger in the humidifier in FIG. 1. In FIG. 1, the humidifier includes a heat exchanger 1 having inside an absorbent 2 which allows passage of air, a driving motor 3 and a driving belt 4 to drive heat exchanger 1, an air intake opening 5 leading to the indoors, fans 6 and 9 to create air flows 7, 7A, 10 and 10A denoted by the arrows within the humidifier, an air exhaust opening 8 leading to the outdoors, a heater 11 and a heater duct 12 to heat air, and an air blower opening 13 leading to the indoors. In FIG. 1, arrows 7 (7A) and 10 (10A) denote flows of air associated with heat exchanger 1. FIG. 2 shows how heat exchanger 1, driving motor 3 and driving belt 4 are coupled, and the region (range) of absorbent 2 through which air flows 7 and 10 pass.

Absorbent 2 in a honeycomb shape is incorporated into cylindrical heat exchanger 1 in the humidifier shown in FIG. 1. Absorbent 2 does not have to be in such a honeycomb shape as in this embodiment, and may be in a grid, sponge or net form as far as it allows passage of air.

As shown in FIG. 2, driving motor 3 is attached with a cylindrical gear 3A rotated by motor 3. Driving belt 4 is placed around the outer circumference of cylindrical heat exchanger 1 and gear 3A. The inner toothed surface of driving belt 4 engages with gear 3A. As gear 3A is rotated by driving motor 3, driving belt 4 rotates as well which rotates heat exchanger 1. Heat exchanger 1 rotates at a speed about in the range from 10 to 30 rph. As heat exchanger 1 rotates, integrally formed absorbent 2 rotates.

The humidifier in FIG. 1 is provided with a plurality of air passages through which air flows by driving of fans 6 and 9. In FIG. 1, an air distribution passage To extends from intake opening 5 leading to the indoors, and branches to a first air passage $T_1$ and a second air passage $T_2$.

First air passage $T_1$ is attached with fan 6. As fan 6 operates, indoor air is taken from intake opening 5 leading to the indoors, and flows through first air passage $T_1$ as air flow 7. Air flow 7 passes through absorbent 2, and is then let out from exhaust opening 8.

Second air passage $T_2$ is attached with fan 9. As fan 9 operates, indoor air is taken from intake opening 5, flows through second air passage $T_2$ as air flow 10 and passes through absorbent 2. In second air passage $T_2$, there are provided heater 11 and heater duct 12 covering heater 11 on the upper stream side of air flow 10 relative to absorbent 2. Air flow 10 reaches heater duct 12 through second air passage $T_2$, heated by heater 11 within heater duct 12, passes through absorbent 2 and is sent indoors from blower opening 13.

As described above, first and second air passages $T_1$ and $T_2$ are provided such that air flows 7 and 10 both pass through absorbent 2. Since first and second air passages $T_1$ and $T_2$ are independent passages, while one air flow passes through part of absorbent 2, the other air flow will not pass through that part. More specifically, only air flow 7 passes through the portion of absorbent 2 corresponding to the range denoted by arrow 14 in FIG. 2 (hereinafter referred to as "region A"), and only air flow 10 passes through the portion of absorbent 2 at a position opposing heater duct 12 (hereinafter referred to as "region B").

In FIG. 2, point 15 represents a point on absorbent 2. Since absorbent 2 rotates, point 15 rotates and moves together with absorbent 2. Arrow 16 represents the moving path of point 15. As point 15 moves as denoted as arrow 16 within region A (the solid portion of arrow 16), only air flow 7 passes through point 15, and as point 15 is within region B (the dotted line portion of arrow 16), only air flow 10 passes through point 15.

In the humidifier, indoor air is taken into the humidifier as fans 6 and 9 operate. Air flow 7 passing through first air passage $T_1$ passes through the portion of absorbent 2 within region A. At the time, moisture in air flow 7 is absorbed by absorbent 2. Desorbed and dried air flow 7A passes through first air passage $T_1$ and is let outdoors by exhaust opening 8.

Air flow 10 is sent to heater duct 12 through second air passage $T_2$, and heated by heater 11. Thereafter, as air flow 10 passes through absorbent 2, absorbent 2 rotates together with heat exchanger 1 by driving motor 3, and the portion of absorbent 2 which has absorbed the moisture in air flow 7 moves to region B. As heated air flow 10 passes through the portion of absorbent 2 containing the moisture, the moisture absorbed by absorbent 2 evaporates to generate vapor. Air flow 10A containing the vapor is passed through second air passage $T_2$ and sent indoors from blower opening 13.

In the humidifier shown in FIG. 1, only fan 6 of fans 6 and 9 may be operated. As only fan 6 operates, indoor air is let outdoors and an equal amount of outdoor air to the let out indoor air is let into the room by natural ventilation, and the room can be ventilated.

Second Embodiment

Figure 3:
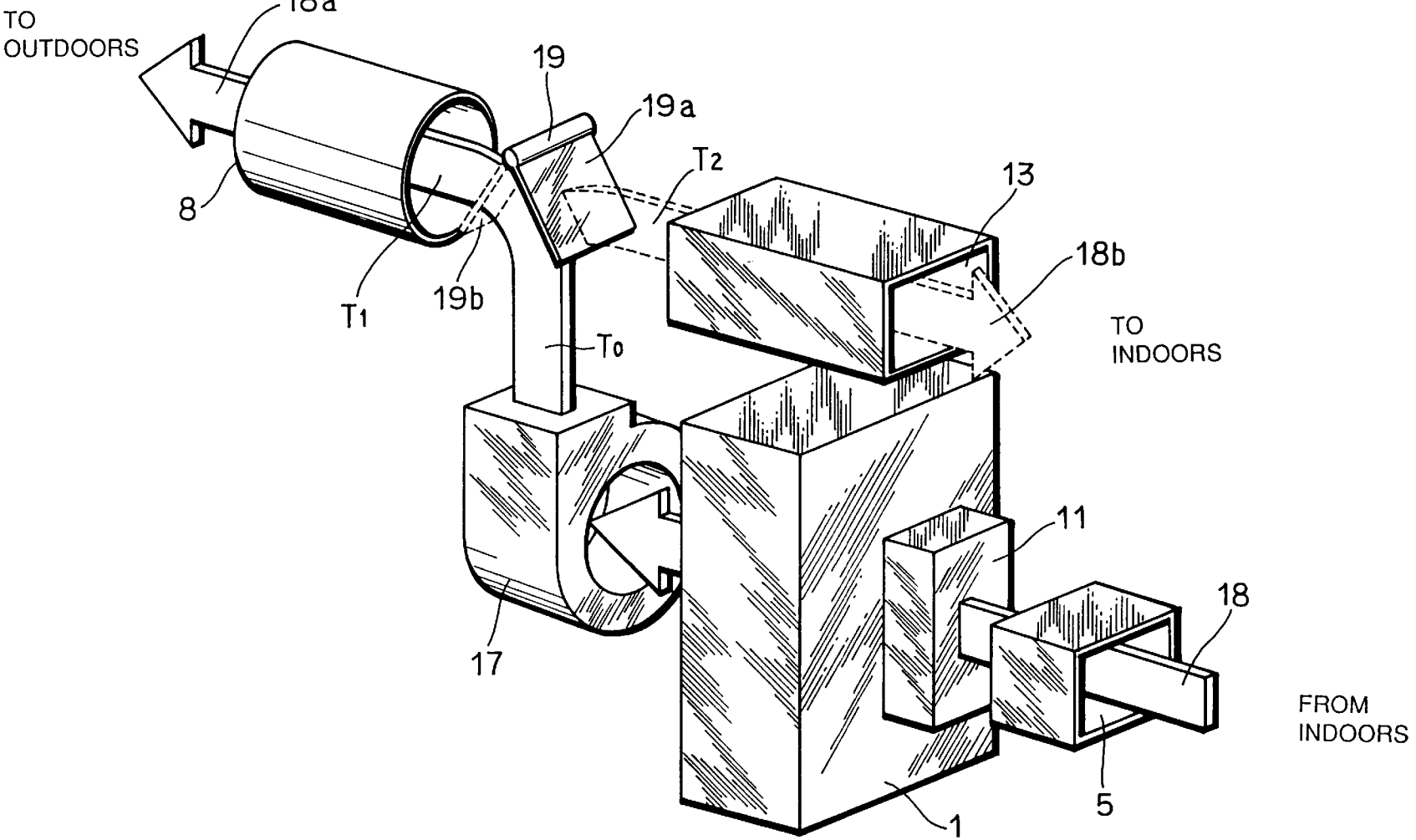
FIG. 3 is a view schematically showing the structure of a humidifier according to a second embodiment of the invention.

FIG. 3 is a view schematically showing the structure of a humidifier according to a second embodiment of the invention. In FIG. 3, arrows 18, 18*a* and 18*b* represent air flows. In FIG. 3, an absorbent (not shown) is incorporated into rectangular parallelepiped heat exchanger 1 which allows passage of air. The absorbent may be any of gas permeable type as is with the first embodiment.

As is with the first embodiment, the humidifier is provided with air passages $T_0$, $T_1$, and $T_2$, in which air flows 18, 18*a*, and 18*b* are generated. Air passage $T_0$ is provided such that air flow 18 passes from intake opening 5 leading to the indoors through the absorbent in heat exchanger 1. In air passage $T_0$, a fan 17 is provided on the downstream side of air flow 18 relation to the absorbent. As fan 17 operates, indoor air is taken in from intake opening 5, and flows through air passage $T_0$ as air flow 18.

In air passage $T_0$, there is provided a heater 11 on the upper stream side of air flow 18 relative to the absorbent.

While heater 11 operates, air flow 18 is heated by heater 11 and then passes through the absorbent. As heater 11 stops operating, air flow 18 passes through the absorbent without being heated.

Air passage $T_0$ branches to a first air passage $T_1$ and a second air passage $T_2$ on the downstream side of fan 17. At the branching point of air passage $T_0$, a damper 19 is provided. As indicated by the solid line in FIG. 3, when damper 19 is at a position 19*a,* air flow 18 passes through first air passage $T_1$ and is let outdoors from exhaust opening 8. In FIG. 3, as denoted by the dotted line, when damper 19 is at a position 19*b,* air flow 18 passes through second air passage $T_2$ and is sent indoors from blower opening 13.

In the humidifier according to the second embodiment, as fan 17 first operates, indoor air is taken into the humidifier. The indoor air passes through air passage $T_0$ in the form of air flow 18, and passes through the absorbent in the midway.

During a fixed time period since fan 17 starts operating, heater 11 stops operating, and damper 19 is at a position 19*a.* At the time, air flow 18 passes through the absorbent without being heated and moisture in air flow 18 is absorbed by the absorbent. Since damper 19 is at position 19*a,* the desorbed and dried air flow 18*a* (shown in solid line) passes through first air passage $T_1$ and is let outdoors from exhaust opening 8. This is referred to as a first procedure.

After the first procedure, heater 11 operates for a fixed time period, and damper 19 stays at position 19*b.* At the time, air flow 18 is heated by heater 11 and then passes through the absorbent. As heated air flow 18 passes through the absorbent containing the moisture, the moisture absorbed by the absorbent evaporates to generate vapor. Since damper 19 is at position 19*b,* air flow 18*b* containing the vapor (shown in dotted line) passes through second air passage $T_2$ and is sent into the room from blower opening 13. This is referred to as a second procedure. After the second procedure, the first procedure is once again repeated.

Thus, the humidifier according to the second embodiment alternately repeats the first and second procedures. More specifically, during a certain fixed time period, moisture for humidification is taken from air, then during a subsequent fixed time period, the moisture is discharged to humidify air. This is repeatedly performed to humidify the indoor air.

As described above, the humidifier according to the first and second embodiments takes in moisture from indoor air and returns the moisture again to indoor air, in other words keeps the moisture in the indoor air from escaping outdoors. However, indoor air is let outdoors at the same time, an equal amount of outdoor air to the let out indoor air comes into the room by natural ventilation. The moisture in the outdoor air increases the total moisture in the indoor air, thus humidifying the indoor air.

In the second embodiment, if, without alternately performing the first and second procedures, damper 19 is held at position 19*a,* and only fan 17 is operated (heater 11 is not operated), indoor air is let outdoors. As indoor air is let out, an equal amount of outdoor air to the let out indoor air comes into the room by natural ventilation, the indoor air can be ventilated.

Figure 4A:
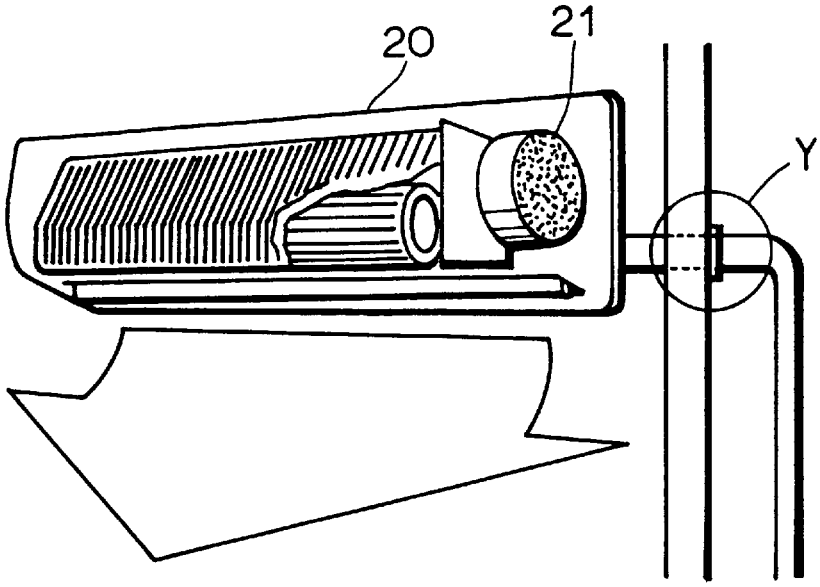
FIGS. 4A–4C are overviews showing how the humidifier according to the first or second embodiment is installed in the indoor unit of an air conditioner.
Figure 4B:
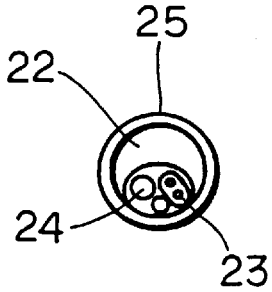
Figure 4C:
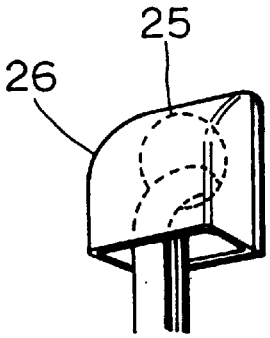

FIGS. 4A–4C are overviews showing how the humidifier according to the first or second embodiment is installed in the indoor unit of an air conditioner. When the above-described humidifier is incorporated into the indoor unit of the air conditioner, the exhaust duct of the humidifier, the refrigerant pipe of the indoor unit and a drainage pipe are provided using a common tubing hole penetrating through a wall. As the tubing hole is shared, it would be easier to attach the indoor unit, a specific example of which is given in FIGS. 4A–4C.

Figure 5C:
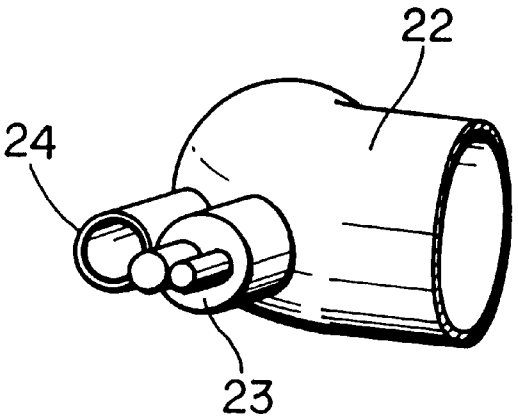
FIGS. 5A–5C are cross sectional views showing an exhaust duct, a refrigerant pipe and a drainage pipe in an integral form shown in FIG. 4B.
Figure 5B:
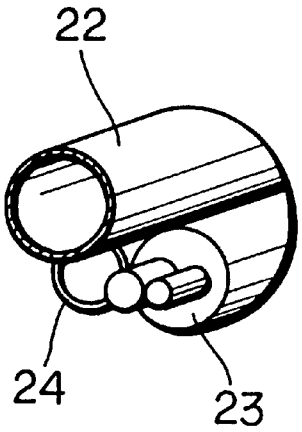
Figure 5A:
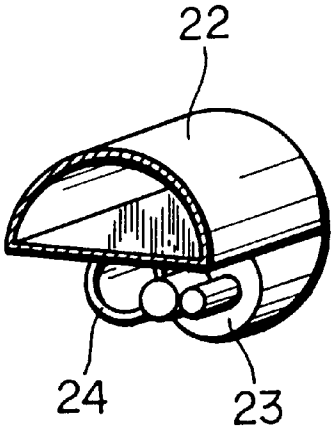

In FIG. 4A, an indoor unit 20 connected to the outdoor unit (not shown) of an air conditioner through a tubing hole 25 provided in a wall. Indoor unit 20 includes humidifier 21 as described above. FIG. 4B shows a hole 25 in portion Y of FIG. 4A. In FIG. 4B, exhaust duct 22, the refrigerant pipe 23 of air conditioner and a drainage pipe 24 are integrally formed and share tubing hole 25. In FIG. 4C, a cover 26 covering tubing hole 25 is attached on the outdoor side to prevent wind and rain from coming into the room from hole 25. FIGS. 5A–5C are cross sectional views showing exhaust duct 22, refrigerant pipe 23 and drainage pipe 24 in the integral form shown in FIG. 4B. Exhaust duct 22, refrigerant pipe 23 and drainage pipe 24 are integrated in various manners for example as shown in FIGS. 5A–5C.

Third Embodiment

According to a third embodiment of the invention, a humidifier having stable and reliable humidifying performance and a reduced size is provided.

Figure 6:
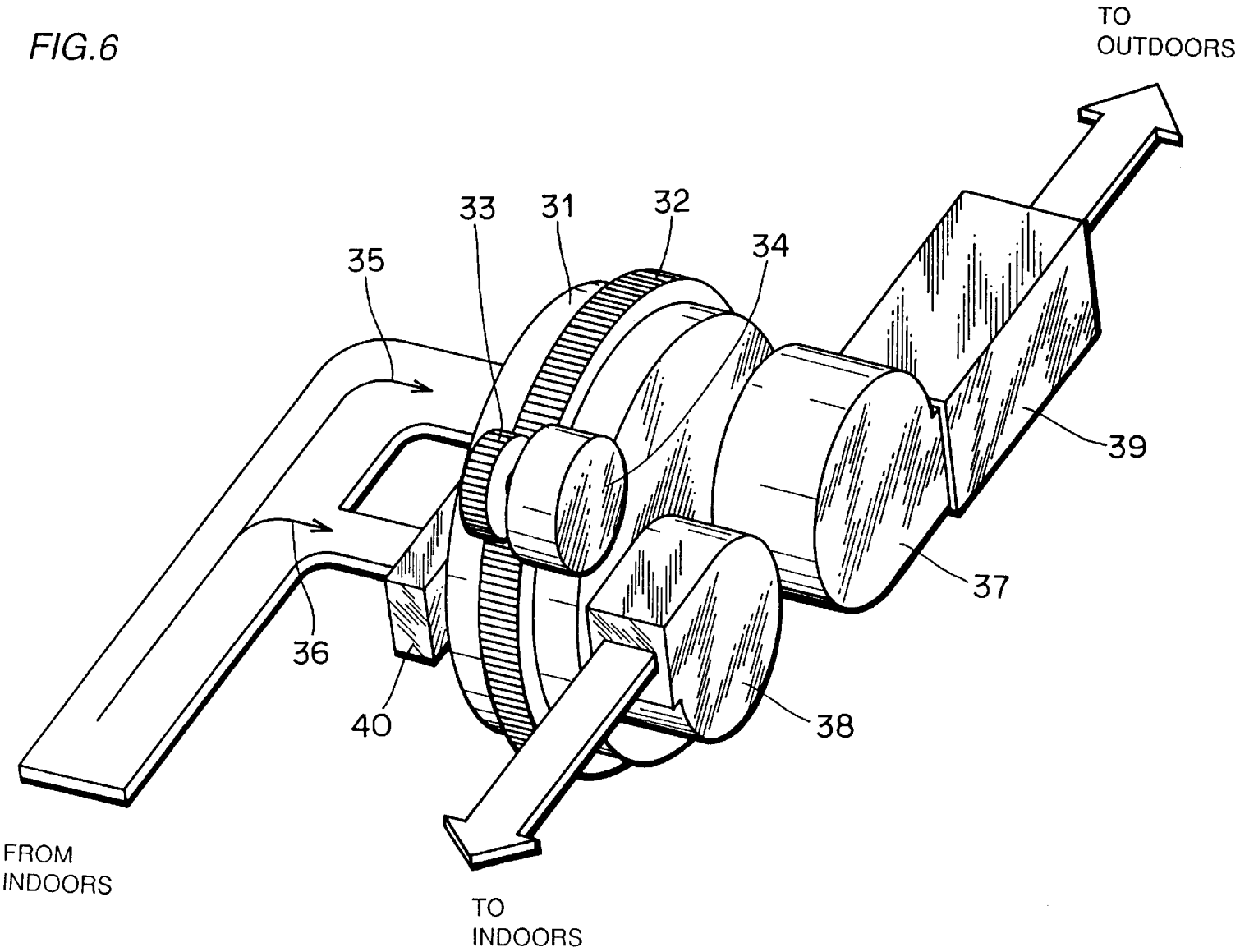
FIG. 6 is a perspective view showing a humidifier according to a third embodiment of the invention.

FIG. 6 is a perspective view showing the humidifier according to the third embodiment. The humidifier in FIG. 6 includes a rotating heat exchanger 31, a large driving gear 32, a small driving gear 33 and a driving motor 34 to rotate heat exchanger 31, fans 37 and 38 to cause air flows 35 and 36 within the humidifier, a duct 39 leading to the outdoors, and a heater 40.

An absorbent absorbing moisture is placed within heat exchanger 31 which permits passage of air. Since heat exchanger 31 has gear 32 fixed at its outer circumference, it is driven to rotate at a low speed (about in the range from 10 to 30 rph) as driving motor 34, a rotation driving member attached with gear 33 which is in cooperation with gear 32 rotates. First and second air flows 35 and 36 are of indoor air. First flow 35 of air taken from the indoors by first fan 37 has its moisture absorbed by the absorbent and becomes dried air as it passes through heat exchanger 31, and is let outdoors through first fan 37 and duct 39. The second flow 36 of air taken from the indoors by second fan 38 is heated as it passes through heater 40 and passes through heat exchanger 31 as air of an increased temperature. At the time, since the moisture which has been absorbed by the absorbent evaporates, air flow 36 becomes highly humid air, and is supplied to the indoors through second fan 38. Thus, dried air is let out from the indoors to the outdoors while air containing moisture is let in from the outdoors by natural ventilation, the amount of moisture contained in the air in the room increases, and increase in the humidity is enabled.

Note that the absorbent in heat exchanger 31 may take a honeycomb, grid, net or sponge shape or any form which permits passage of air.

As shown in FIG. 6, first and second fans 37 and 38 to cause first and second air flows 35 and 36 do not have to be placed on the side to take in air relative to heat exchanger 31, and may be placed on the side to force air into heat exchanger 31 (on the left side of heat exchanger shown in FIG. 6 in other words on the side of heat exchanger 31 to take in air).

In this case, only one fan may be used to form first and second air flows rather than two fans.

In addition, large driving gear 32 does not have to have a width smaller than the width of heat exchanger 31, and may be formed on the surface of a casing covering heat exchanger 31 in such a manner to permit passage of air through the absorbent. Alternatively, gear 32 does not have to be in direct contact with heat exchanger 31 as far as heat exchanger 31 rotates by the rotation of small driving gear 33.

The humidifier according to the third embodiment as shown in FIG. 6 is thus provided with gear 32, driving motor 34 and gear 33 in connection with the rotation of heat exchanger 31, and motor 34 rotates gears 32 and 33 in engagement to rotate heat exchanger 31. Therefore, in comparison with a humidifier to rotate heat exchanger 32 with a common driving belt placed on heat exchanger 31 and driving motor 34, heat exchanger 31 and driving motor 34 can be installed closer to each other in the humidifier according to this embodiment, in other words the humidifier may be more compact. Furthermore, since the rotation of driving motor 34 is transmitted to heat exchanger 31 through gears 32 and 33, irregular rotations or rotation faults of heat exchanger 31 which would be encountered in the case of the humidifier using the driving belt as described above can be surely prevented in the humidifier according to this embodiment, and therefore reliable and highly stable humidifying performance can be secured.

Fourth Embodiment

Figure 7:
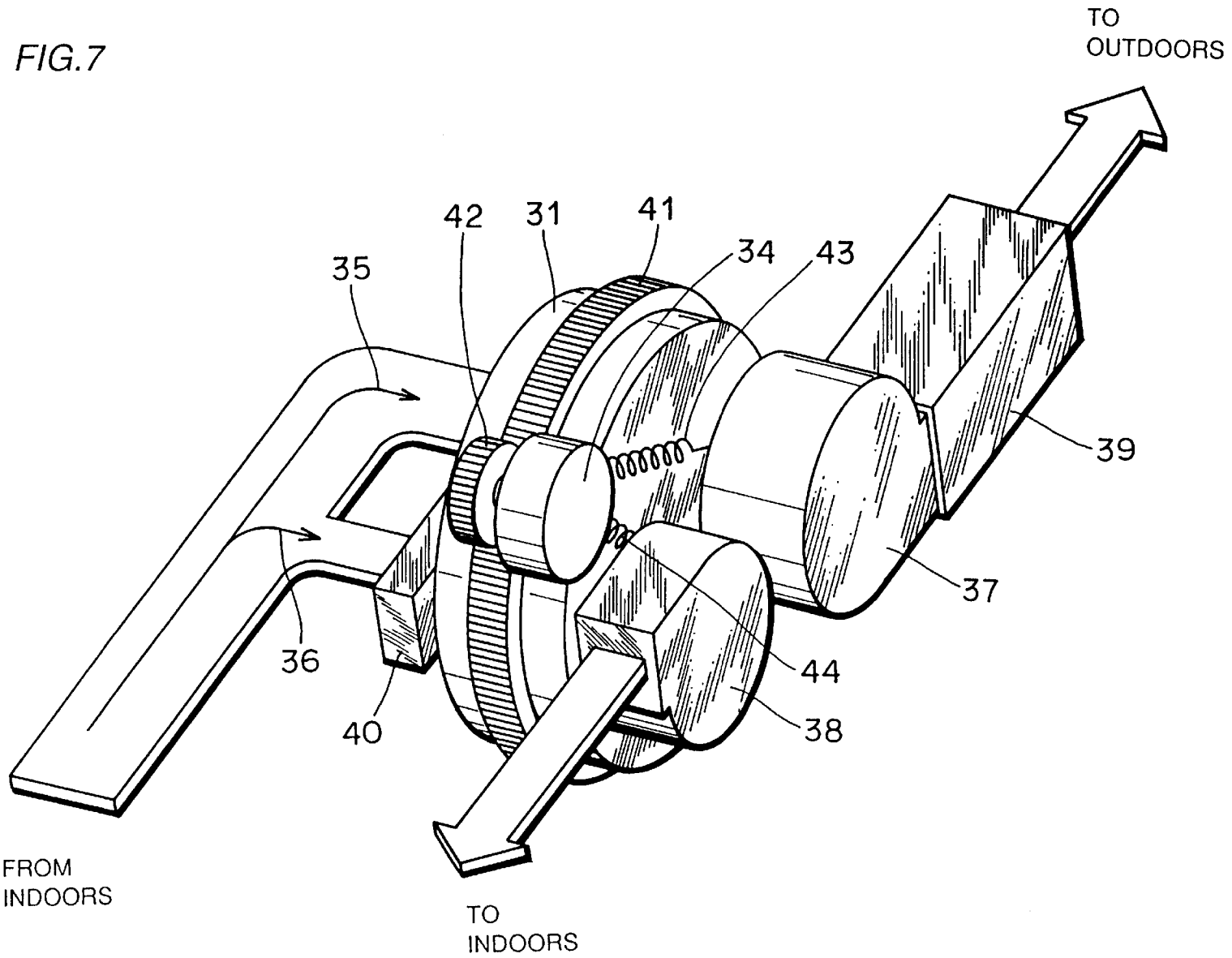
FIG. 7 is a perspective view showing a humidifier according to a fourth embodiment of the invention.

A fourth embodiment is a variation of the humidifier according to the third embodiment. FIG. 7 is a perspective view showing the humidifier according to the fourth embodiment. In the description of the humidifier according to this embodiment, the portions serving the same functions as those in the third embodiment are denoted by the same reference characters, and a description thereof will not be provided.

In the humidifier shown in FIG. 7, an absorbent is formed in heat exchanger 31. A belt 41, (a member having a high friction coefficient is adhesively fixed to the outer circumference of heat exchanger 31) and heat exchanger 31 are driven to rotate at a low speed (about in the range from 10 to 30 rph) by driving motor 34 to which a belt 42 is attached (a member with a high friction coefficient).

Belts 41 and 42 have high friction coefficients for teeth formed on their surfaces. Instead of forming the teeth, belts 41 and 42 may be formed of a material with a high friction coefficient.

In FIG. 7, driving motor 34 is fixed under constant pressure between belts 41 and 42 using elastic springs 43 and 44.

The flow of air and the method of humidification in the device shown in FIG. 7 as well as the shape of heat exchanger 31 and the position to attach fans 37 and 38 are the same as those in the third embodiment as described above.

Belt 41 does not have a width smaller than heat exchanger 31 as shown in FIG. 7, and may be formed for example on the surface of a casing covering heat exchanger 31. Belt 41 may be fixed in indirect connection to heat exchanger 31 rather than in direct contact as long as heat exchanger 31 rotates by the rotation of belt 42.

In order to constantly impose fixed pressure between belts 41 and 42, an elastic member of rubber, for example, may be used in place of springs 43 and 44. In order to impose fixed pressure between belts 41 and 42, heat exchanger 31 may be elastically fixed instead of fixing driving motor 34 as shown in FIG. 7.

As described above, in the humidifier according to this embodiment, heat exchanger 31 is provided with belt 41, driving motor 34 is provided with belt 42, and heat exchanger 31 and driving motor 34 are fixed such that belt 41 and 42 abut against each other under pressure. In the humidifier according to this embodiment, heat exchanger 31 and driving motor 34 can be provided closer than the humidifier using a common driving belt placed around the heat exchanger and the driving motor, and therefore the device can be reduced in size. Furthermore, since the rotation of driving motor 34 is transmitted to heat exchanger 31 through belts 41 and 42 having high friction coefficients, irregular rotations or rotation faults can be surely prevented, and therefore highly reliable humidifying performance can be stably secured.

In addition, since driving motor 34 is fixed by springs 43 and 44, the positional relation between heat exchanger 31 and driving motor 34 can be appropriately adjusted by the elastic force of springs 43 and 44. As a result, the precision of assembling heat exchanger 31 and driving motor 34 is simplified, the assembling convenience improves, which reduces time required for assembling. Therefore, the humidifier can be manufactured at lower cost.

In the above-described humidifier, air flow 35 taken in from the outdoors by fan 37 is initially removed of its moisture by the absorbent when it passes through heat exchanger 31. Since the absorbent does not absorb more than a fixed amount of moisture, and the air is let outdoors through fan 37 and duct 39 as it keeps its humidity, ventilation is enabled. At this time, the ventilation is enabled regardless of whether or not driving motor 34 for heat exchanger 31 and fan 38 operate.

The above humidifier according to the third or fourth embodiments is integrally attached to the indoor unit of the air conditioner as shown in FIG. 4A. The exhaust duct, the refrigerant pipe of the air conditioner and the drainage pipe are integrally formed as shown in FIGS. 4B and 5A–5C and share tubing hole 25.

Fifth Embodiment

In a fifth embodiment, there is provided a ventilation duct which is less prone to damages when attached to an air conditioner capable of humidifying air.

The ventilation duct for the air conditioner according to the fifth embodiment will be described.

Figure 9A:
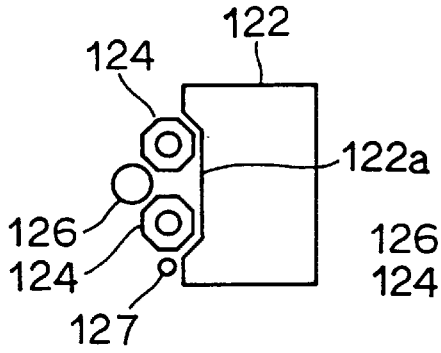
FIGS. 9A–9C are cross sectional views showing the connecting portion in FIGS. 8A–8D.
Figure 9B:
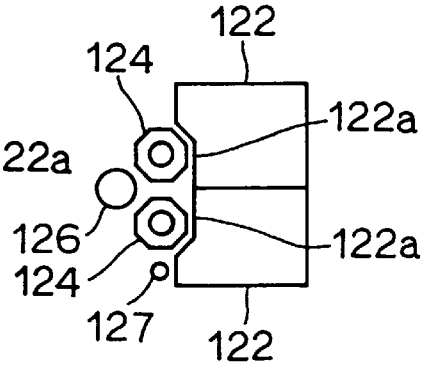
Figure 9C:
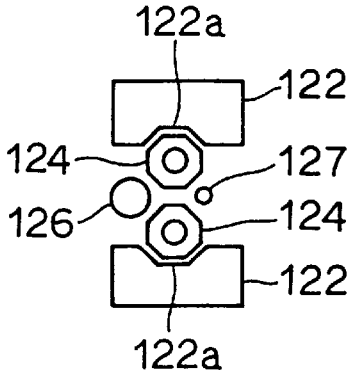
Figure 10A:
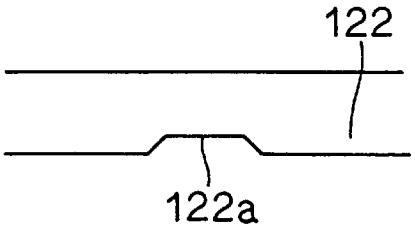
FIGS. 10A and 10B are side views showing the ventilation duct in FIGS. 8A–8D.
Figure 10B:
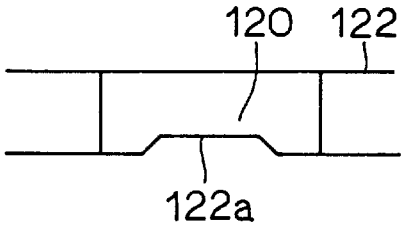

The same portions as those in FIGS. 28A, 28B and 29A–29D are denoted with the same reference characters, and a description thereof will not be provided. FIGS. 8A–8D are cross sectional views showing the connecting portion of a refrigerant pipe in the ventilation duct according to the fifth embodiment. FIGS. 9A–9C are cross sectional views showing the connecting portion in FIGS. 8A–8D. FIGS. 10A and 10B are side views showing the ventilation duct in FIGS. 8A–8D.

Figure 8A:
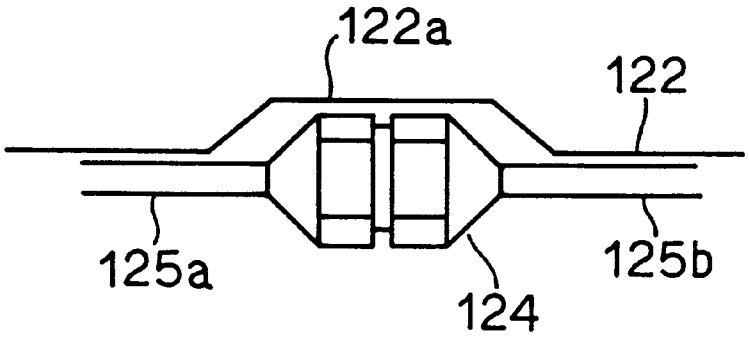
FIGS. 8A–8D are cross sectional views showing the connecting portion of a refrigerant pipe in a ventilation duct according to a fifth embodiment of the invention.
Figure 8B:
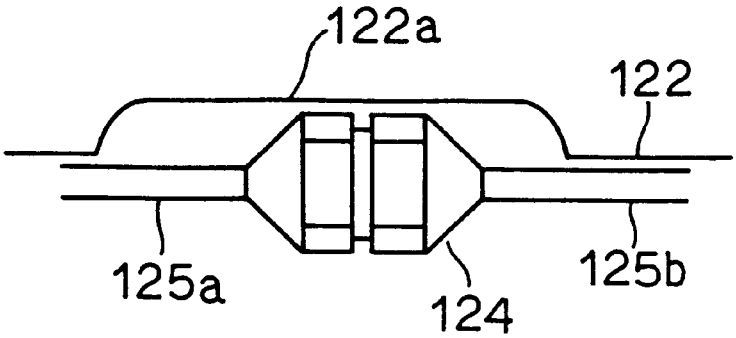

In FIGS. 8A and 8B, the surface of ventilation duct 122 facing the connecting portion 124 of refrigerant pipe 125 has a recess (contact protecting portion) 122*a* depressed toward the inner surface of ventilation duct 122. Recess 122*a* formed in ventilation duct 122 secures an enough distance between connecting portion 124 and the surface of ventilation duct 122. Thus, the ventilation duct 122 is prevented from being damaged by force imposed on ventilation duct 122 as connecting portion 124 touches the surface of ventilation duct 122 during attaching ventilation duct 122.

Figure 8C:
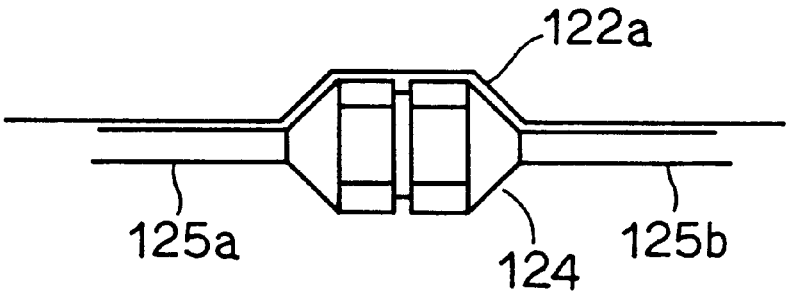
Figure 8D:
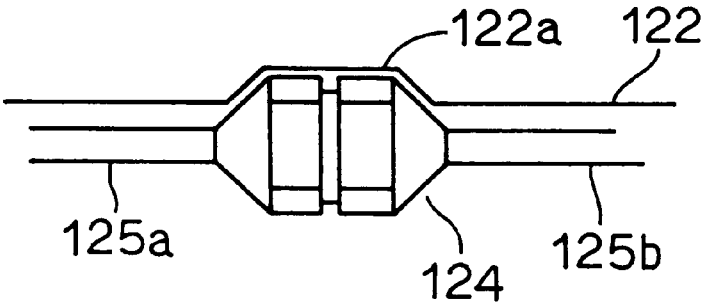

In FIGS. 8C and 8D, recess 122*a* and connecting portion 124 are provided in contact with each other. More specifically, the shape of recess 122*a* is virtually identical to the shape of connecting portion 124, the inclined surfaces of recess 122*a* are in contact with the entire inclined surfaces of connecting portion 124. Therefore, ventilation duct 122 receives force from contacting portion 124 in a wider area than the conventional cases shown in FIGS. 28A, 28B and 29A–29D, ventilation duct 122 can be prevented from being locally stressed, so that damages to ventilation duct 122 caused by contacting portion 124 during attaching duct 122 can be prevented.

FIGS. 9A–9C show a cross sectional structure of connecting portion 124 in FIG. 8A as viewed in the lengthwise direction of ventilation duct 122. In FIG. 9B, there are shown ventilation ducts 122 from the indoor side to the outdoor side and vice versa, and recess 122*a* is formed on the surface of these two ventilation ducts 122 opposite to connecting portion 124. In FIG. 9C, there are shown two ventilation ducts 122 as is with FIG. 9B. These two ventilation ducts 122 are provided on and below two refrigerant pipes 125, and recesses 122*a* are formed at the portions opposite to connecting portions 124.

Ventilation duct 122 may have a part of its surface depressed to form a recess 122*a* as shown in FIG. 10A. As shown in FIG. 10B, a detachable connection duct 120 previously provided with a recess 122*a* may be connected to a desired part of ventilation duct 122 in order to alleviate the attaching of ventilation duct 122.

Figure 11A:
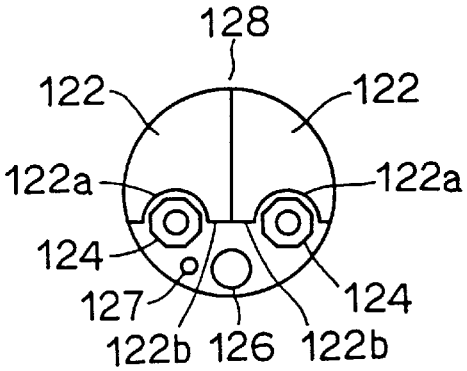
FIGS. 11A and 11B are cross sectional views showing a tubing connecting an indoor unit and an outdoor unit by concentrically accommodating a ventilation duct and a refrigerant pipe according to a fifth embodiment of the invention.
Figure 11B:
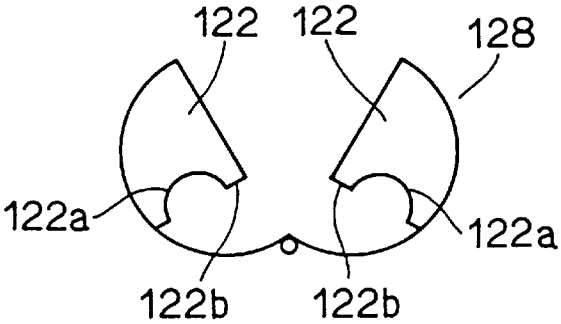
Figure 12:
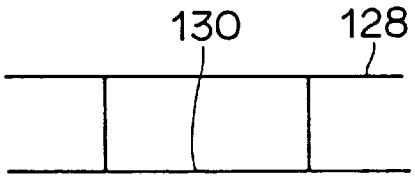
FIG. 12 is a side view showing the ventilation duct in FIGS. 11A and 11B.

FIGS. 11A and 11B are sectional views showing the inside of the tubing connecting the indoor unit and the outdoor unit and accommodating the ventilation duct and the refrigerant pipe according to the fifth embodiment in the same state. FIG. 12 is a side view showing the ventilation duct in FIGS. 11A and 11B. In FIGS. 11A and 11B, two ventilation ducts 122, a drain hose 126, two refrigerant pipes 125 and a power line 127 are accommodated in an integral form in tubing 128. As shown in FIG. 11A, two ventilation ducts 122 are provided in the upper space of tubing 128 having a circular cross section, and drain hose 126, two refrigerant pipes 125 and power line 127 are provided in the lower space. In FIG. 11A, a recess 122*a* is formed at the boundary 122*b* of each of ventilation duct 122 facing the contacting portion 124 of two refrigerant pipes 125, and therefore contacting portion 124 can be prevented from contacting ventilation duct 122 during attaching tubing 128. Therefore, damages to the boundary 122*b* of ventilation duct 122 can be prevented, the internal space of tubing 128 can be effectively utilized and the diameter of tubing 128 can be reduced as well. Furthermore, as shown in FIG. 12, a detachable connecting tube 130 having a recess 122*a* formed at the boundary of 122*b* of ventilation duct 122 is connected to a desired part of tubing 128. Therefore, ventilation duct 122 can be more easily attached.

Sixth Embodiment

In a sixth embodiment, an improvement of the ventilation duct of an air conditioner which makes easier the attachment is provided.

Figure 13:
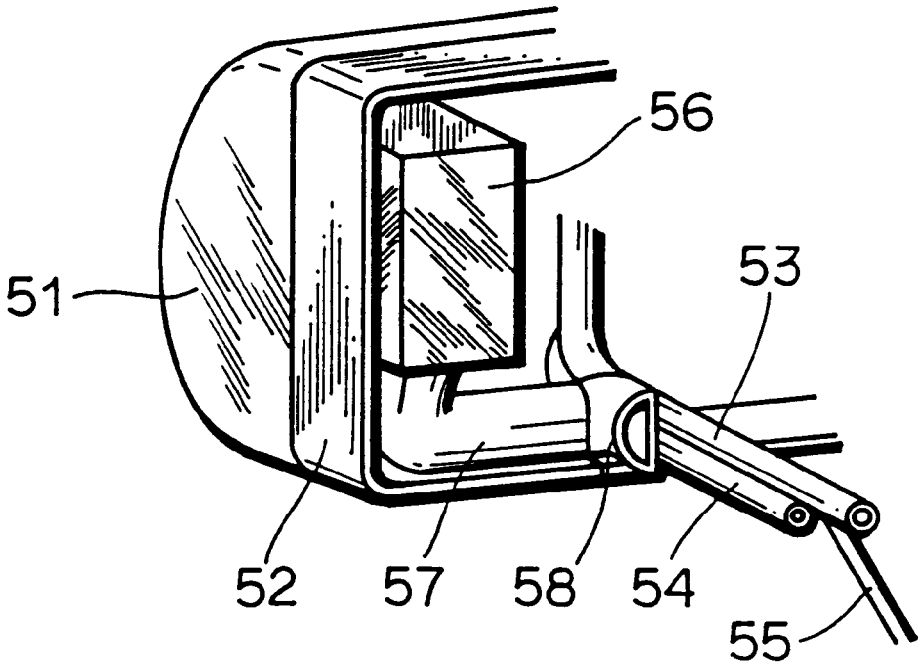
FIG. 13 is a perspective view showing the structure of tubing for the indoor unit of an air conditioner according to a sixth embodiment of the invention.

FIG. 13 is a perspective view showing how a tubing is provided in connection with the indoor unit of an air conditioner according to the sixth embodiment of the invention. In FIG. 13, the tubing is provided on the rear side of the indoor unit. In FIG. 13, a front panel 51 attached to the front surface of the indoor unit and a synthetic-resin molded cabinet 52 for the indoor unit are shown. Front panel 51 is detachably provided to the front surface of cabinet 52. The indoor unit in FIG. 13 is provided with a refrigerant pipe 53 on its rear surface to let refrigerant flow between the indoor unit and the outdoor unit (not shown), a drain hose 54 to discharge outdoor generated drainage water condensed by a heat exchanger (not shown) in the indoor unit, and a power line 55 to supply power to the outdoor unit from the indoor unit. Furthermore, the indoor unit includes a ventilation device 56 having inside a ventilation blower (not shown) to let indoor air outdoors, a connection duct 57 bent in an L-shape and having its one end connected to the ventilation opening of ventilation device 56, and a ventilation duct 58 connected to the other end of connection duct 57 and inserted through the tubing hole (not shown) formed in the wall.

Figure 14:
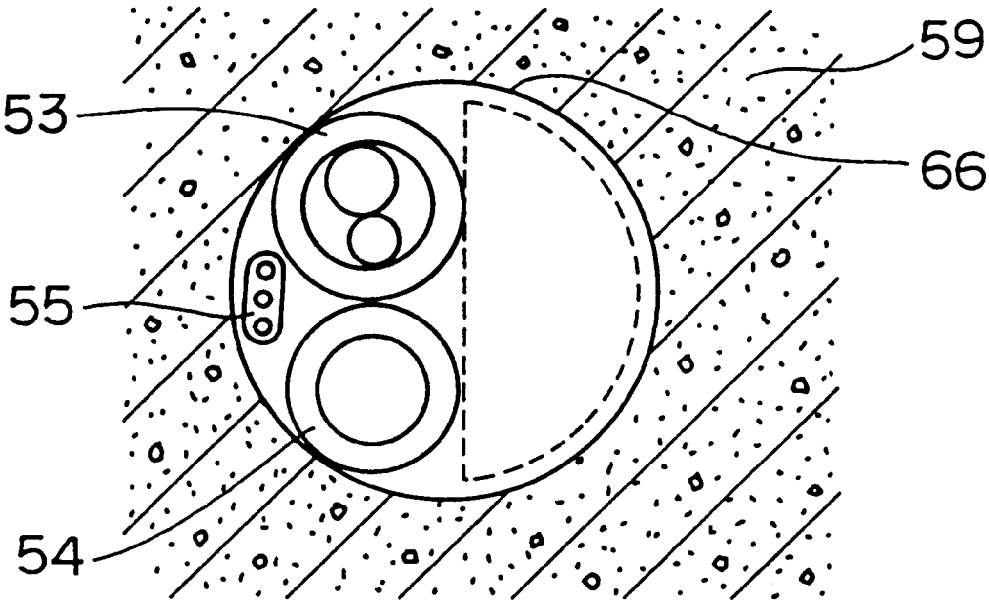
FIG. 14 is a cross sectional view showing various pipes inserted through a pipe hole in FIG. 13.

FIG. 14 is a cross sectional view showing how various pipes shown in FIG. 13 are inserted through the tubing hole. In FIG. 14, refrigerant pipe 53, drain hose 54 and power line 55 are inserted through tubing hole 66 formed in wall 59. The space in tubing hole 66 defined by the dotted line in FIG. 14 is a remaining space after these pipes are provided in tubing hole 66. The space is secured as ventilation duct 58 is inserted from the opening of tubing hole 66 on the outdoor side for a prescribed distance, and refrigerant pipe 53, drain hose 54 and power line 55 are securely fixed in tubing holes 66. Note that the length of ventilation duct 58 inserted in tubing hole 66 is about a distance enough to secure a passage for ventilation in tubing hole 66 by localizing refrigerant pipe 53, drain hose 54 and power line 55 to the side of opening of tubing hole 66 on the indoor side. More specifically, the length of ventilation duct 58 inserted into tubing hole 66 is about 5 cm.

Figure 15:
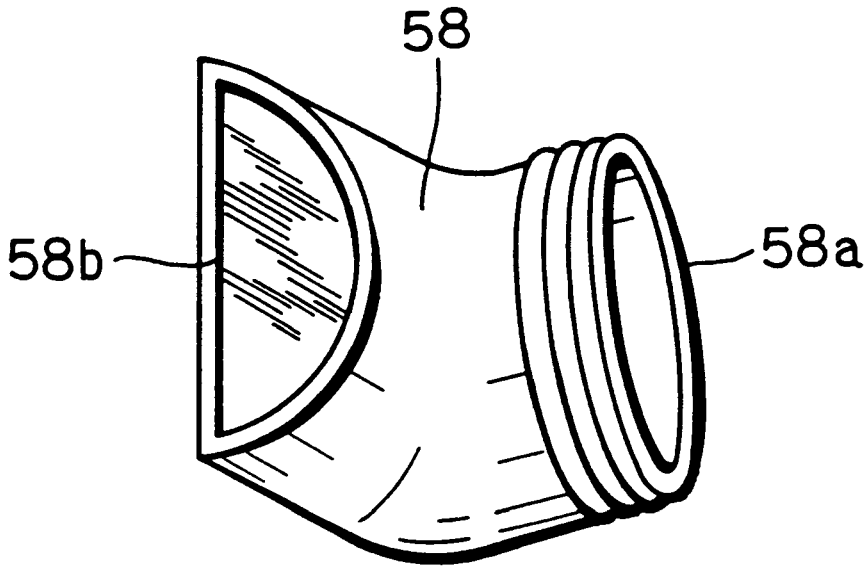
FIG. 15 is a perspective view showing the outer shape of the ventilation duct in FIG. 13.

FIG. 15 is a perspective view showing the outer shape of ventilation duct 58 as shown in FIG. 13. Referring to FIG. 15, tubular ventilation duct 58 has a circular opening 58*a* at its one end and a semicircular opening 58*b* at the other end. Circular opening 58*a* is formed at one end of ventilation duct 58 connected to connection duct 57, and semicircular opening 58*b* is formed at the other end of ventilation duct 58 inserted through tubing hole 66. The shape of semicircular opening 58*b* virtually coincides with the shape of the space in tubing hole 66 defined by the dotted line in FIG. 14. When various pipes are passed through tubing hole 66 formed in the wall facing the rear side of the outdoor unit, refrigerant pipe 53, power line 55 and drain hose 54 are inserted through tubing hole 66 from the indoor side and drawn to the outdoor side, and then ventilation duct 58 is inserted into tubing hole 66 from the indoor side.

Figure 16:
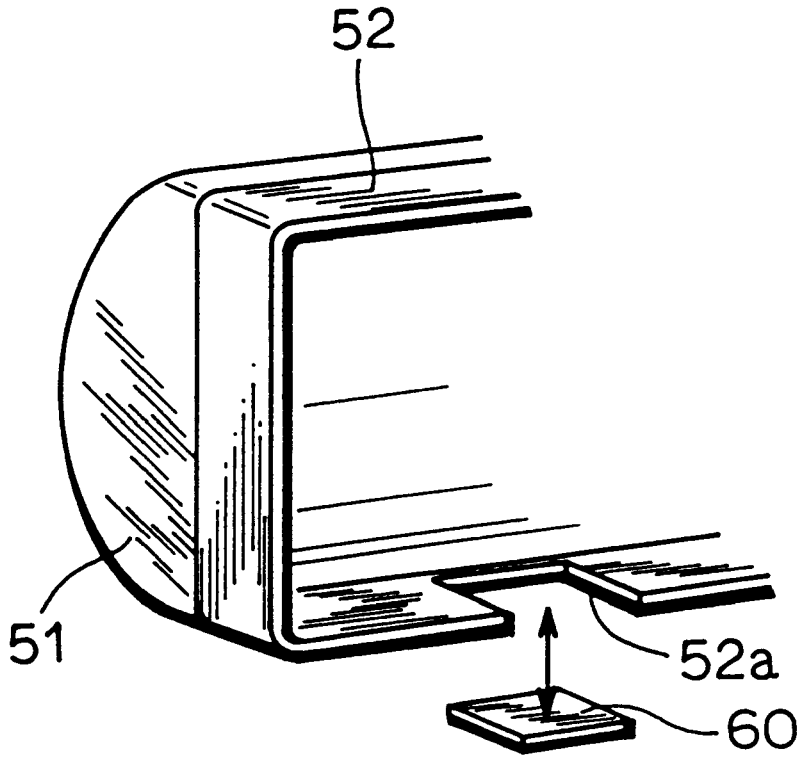
FIG. 16 is a perspective view showing a work window formed in the indoor unit in FIG. 13.
Figure 17:
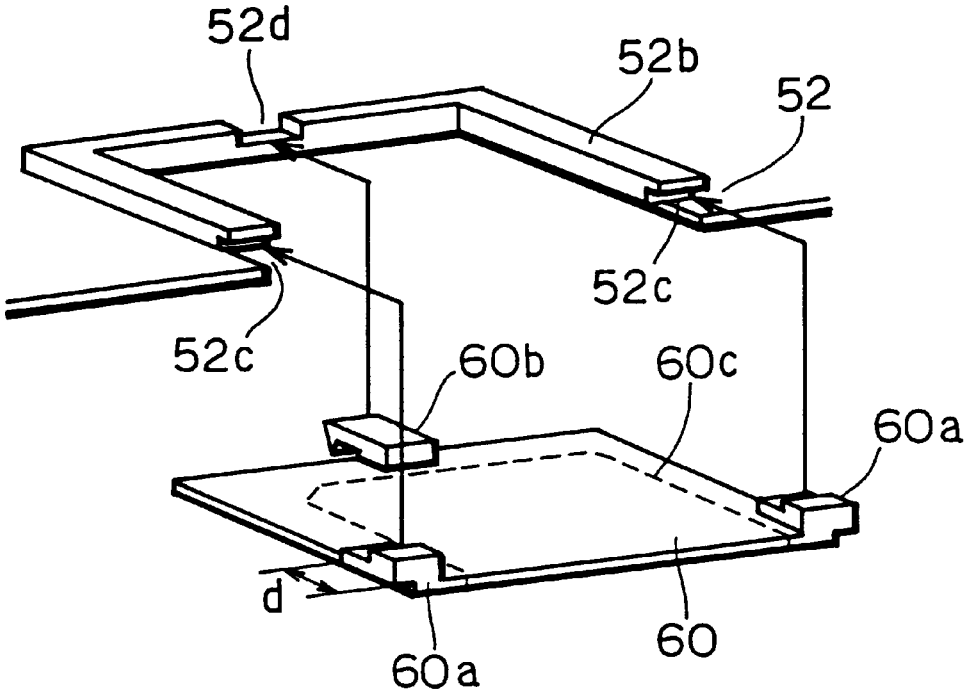
FIG. 17 is a view showing how a lid is attached to/detached from the work window shown in FIG. 16.
Figure 18:
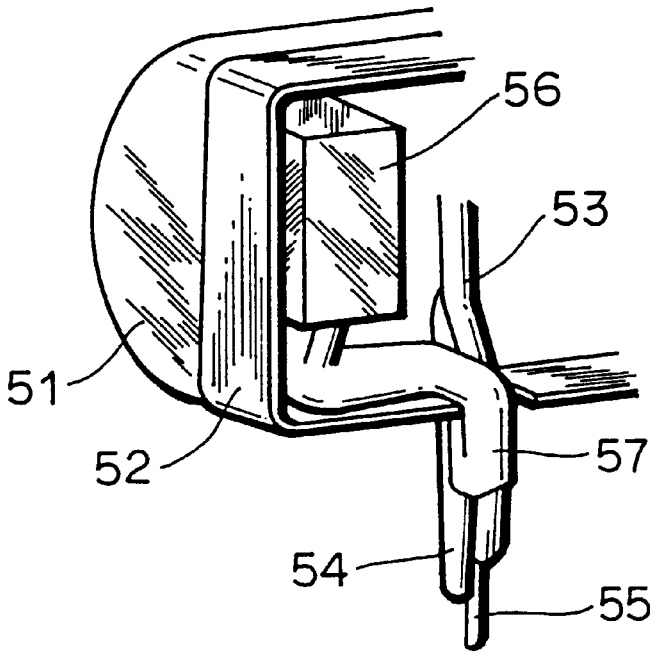
FIG. 18 is a view showing how various pipes are drawn downward from the indoor unit from the work window in FIG. 16.
Figure 19:
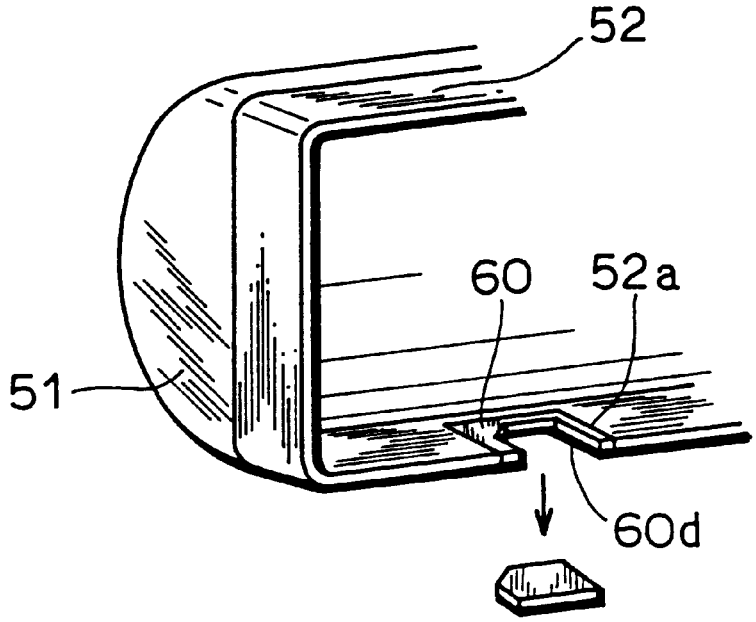
FIG. 19 is a view showing pipes drawn downwardly from the indoor unit through the portion formed by cutting out along the broken line shown in FIG. 17.
Figure 20:
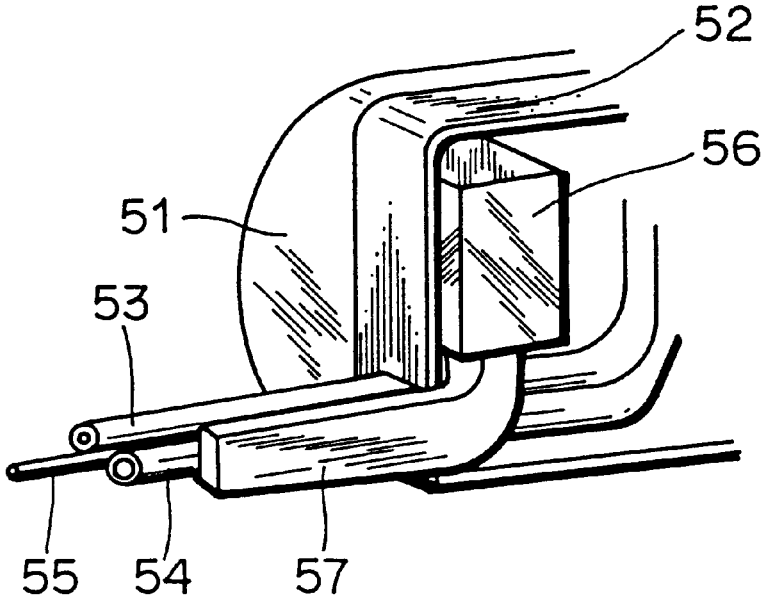
FIG. 20 is a view showing pipes drawn outside from a side surface of the indoor unit in FIG. 13.

FIG. 16 is a perspective view showing a work window formed in the indoor unit in FIG. 13. FIG. 17 is a view how lid is attached to/detached from the work window shown in FIG. 16. FIG. 18 shows how various pipes are drawn below the indoor unit from the work window. FIG. 19 shows how pipes are drawn downwardly from the indoor unit through the portion formed by cutting out a part defined by the dotted line in FIG. 17. FIG. 20 shows how pipes are externally drawn from a side of the indoor unit.

How to draw various pipes downward from a side of cabinet 52 of indoor unit as shown in FIG. 13 will be described in conjunction with FIGS. 16 to 18. In FIG. 16, the cabinet 52 of indoor unit includes a work window 52*a* formed by cutting out a part of the bottom surface and a lid 60 provided to close work window 52*a* and detachable from cabinet 52 as desired. In FIG. 17, a rib 52*b* is provided on the inner side of work window 52*a* to prevent lid 60 from entering into the indoor unit, and rib 52*b* is provided with cut out portions 52*c* and 52*d*. Lid 60 has an engaging portion 60 a to engage cut out portion 52*c*, a securing claw 60*b* to secure lid 60 to work window 52*a* by fitting the lid to cut out portion 52*d*, and a perforation 60*c* to form an opening to draw pipes out which will be described. If the width of the space between the wall to attach the indoor unit and the rear surface of the cabinet 52 of the indoor unit is distance d in FIG. 17, lid 60 can be easily attached to/detached from work window 52*a* in cabinet 52 by sliding lid 60 in the horizontal direction toward the wall side by distance d followed by downward movement.

When ventilation duct 58 is passed through tubing hole 66 in the rear surface of the indoor unit, lid 60 is removed from work window 52*a* on the bottom of cabinet 52 of the indoor unit. The operator then puts a hand inside from work window 52*a*, passes refrigerant pipe 53, drain hose 54 and power line 55 through tubing hole 66, and then insert ventilation duct 58 into tubing hole 66 for a prescribed distance from the side of semicircular opening 58*b* while viewing the remaining space in tubing hole 66. Note that the shape of the remaining space of tubing hole 66 as described above is virtually identical to the shape of semicircular opening 58*b,* ventilation duct 58 can be secured within tubing hole 66 simply by inserting duct 58 into tubing hole 66. Thus, ventilation duct 58 and the remaining space in tubing hole 66 on the outdoor side communicate with each other to form a ventilation passage. After ventilation duct 58 is passed through tubing hole 66, work window 52 is closed by lid 60.

Now, referring to FIG. 18, a description follows on how pipes are provided when tubing hole 66 is formed at a position other than on the rear surface of the indoor unit. In FIG. 18, when refrigerant pipe 53, drain hose 54, power line 55 and connection duct 57 are drawn out downwardly from the indoor unit, work window 52*a* removed of lid 60 is used as an opening to draw out refrigerant pipe 53, drain hose 54, power line 55 and connection duct 57. As another approach, as shown in FIG. 17, a perforation 60*c* formed on the surface of lid 60 is used to form an opening portion to draw out refrigerant pipe 53, drain hose 54, power line 55 and connection duct 57 downward from the side surface of the indoor unit. In this case, as shown in FIG. 19, when the indoor unit is attached, the service person forms an opening 60*d* by cutting out lid 60 using a cutter along perforation 60*c,* and ends of refrigerant pipe 53, drain hose 54, power line 55 and connection duct 57 are drawn externally from the indoor unit through opening 60*d.* Note that perforation 60*c* may be formed by arranging elongate holes like dotted line, a groove for cutting out may be previously formed on the surface of lid 60.

There are previously provided an opening and a lid to close/open the opening as desired at the side surface of cabinet 52. When refrigerant pipe 53, drain hose 54, power line 55 and connection duct 57 are drawn out along the side surface of the indoor unit, after the lid is removed, the direction in which the L-shaped connection duct 57 is attached to ventilation device 56 is changed as shown in FIG. 20. More specifically, connection duct 57 as attached to ventilation device 56 is turned, has its end positioned outside cabinet 52 along the side surface of the indoor unit, then a relay duct or the like is connected to the end and led to tubing hole 66.

Figure 21:
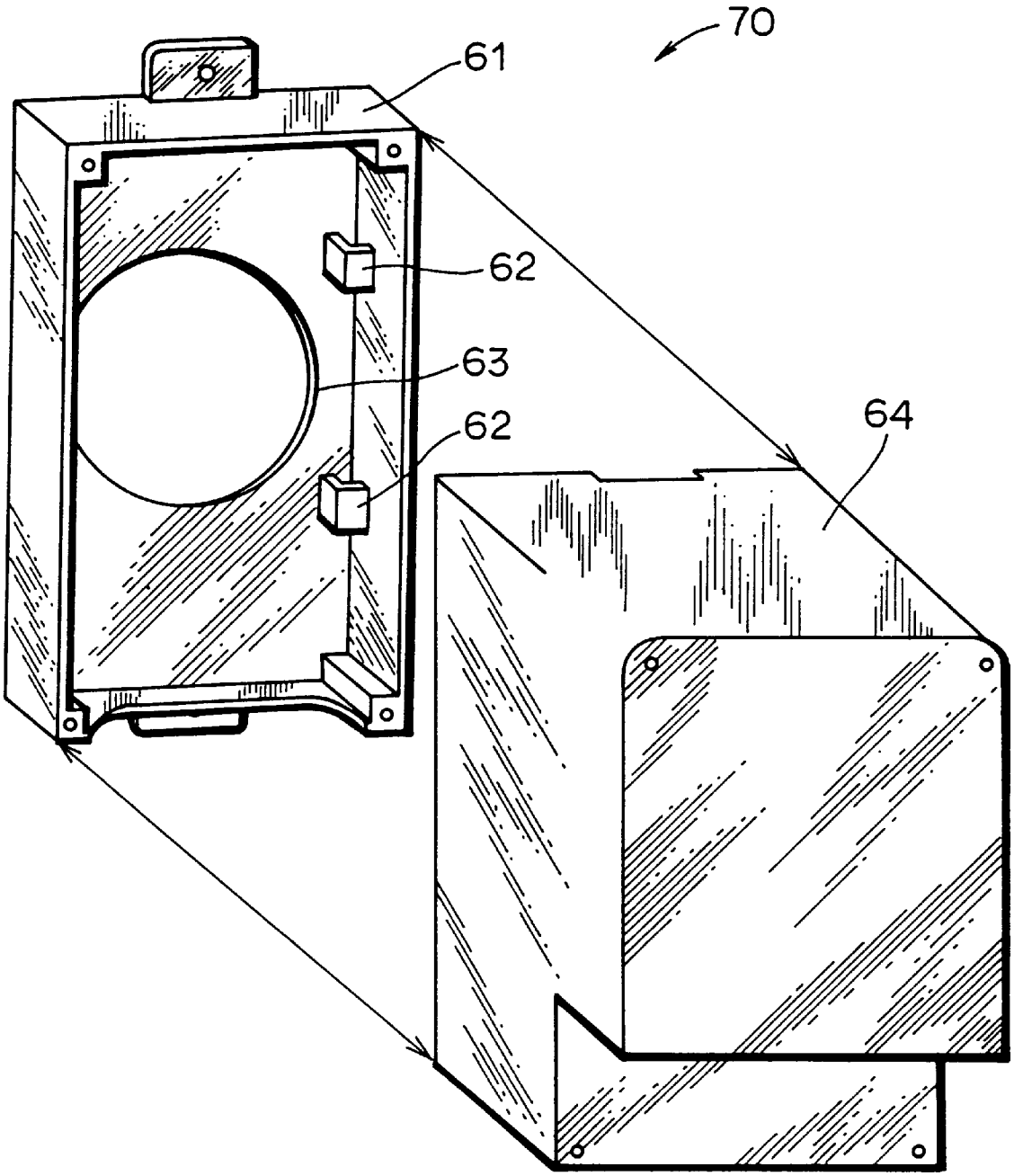
FIG. 21 is a view showing a weathertight cover used for the air conditioner according to the sixth embodiment of the invention.
Figure 22:
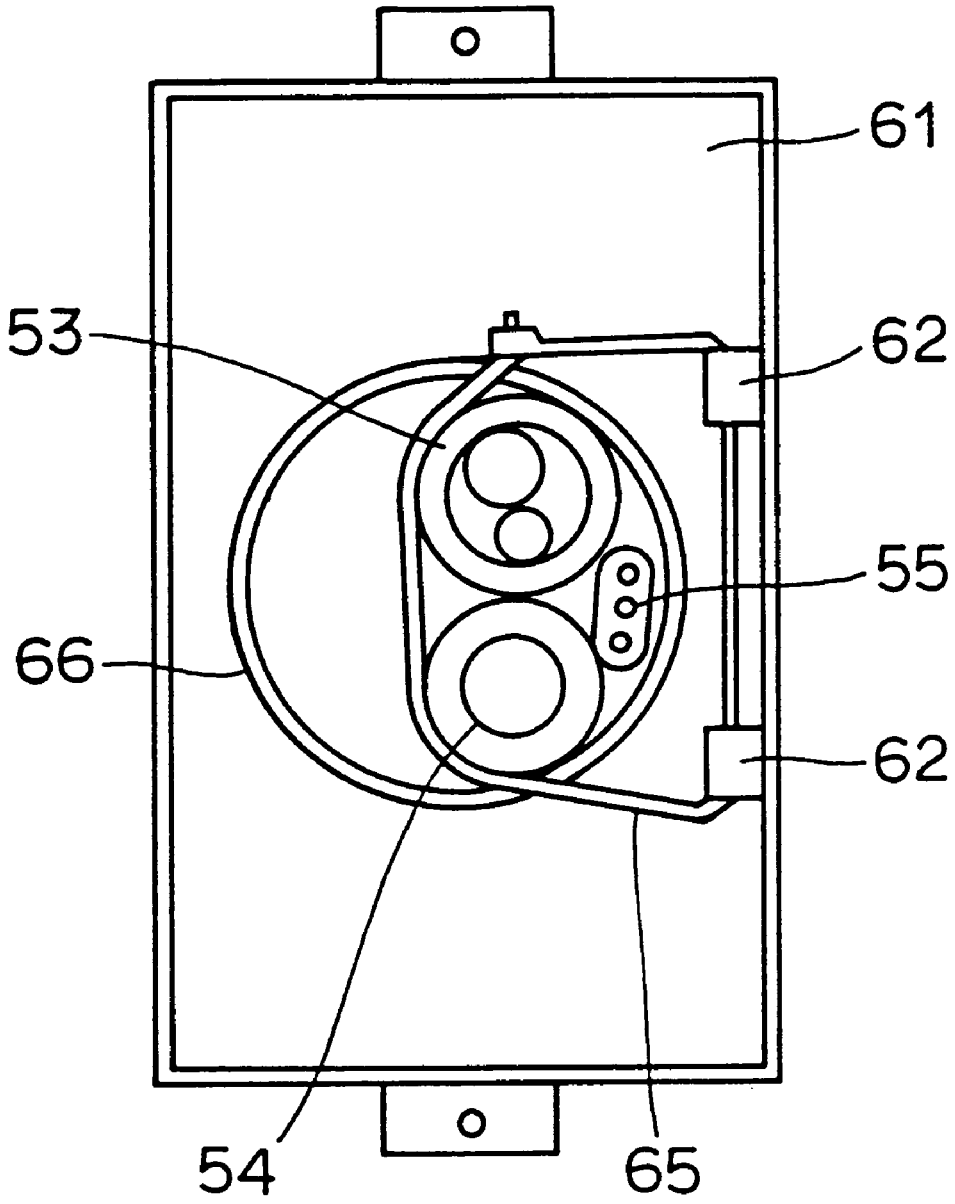
FIG. 22 is a view showing pipes fixed within the weathertight cover in FIG. 21.

FIG. 21 is an exploded view showing a weathertight cover used in the air conditioner according to the fifth embodiment of the invention, and FIG. 22 is a view showing how pipes are fixed in the weathertight cover in FIG. 21. Weathertight cover 70 provided on the outdoor side of tubing hole 66 will be described in conjunction with FIGS. 21 and 22. Weathertight cover 70 is attached to cover the opening on the outdoor side of tubing hole 66 in order to protect the indoor side of tubing hole 66 against the adverse effect of weather. In FIG. 21, weathertight cover 70 includes a base frame 61 attached to the outdoor side opening of tubing hole 66, two engaging claws 62 formed in base frame 61, an opening 63 formed in base frame 61 to pass through various pipes and ventilation duct 58 provided in tubing holes 66, and a cover 64 provided to base frame 61 for preventing rain from coming into tubing hole 66. Note that as weathertight cover 70 is attached, an opening is formed on the lower surface of weathertight cover 70, and refrigerant pipe 53, drain hose 54 and power line 55 are passed through the opening led to the outdoor unit.

In FIG. 22, refrigerant pipe 53, drain hose 54 and power line 55 drawn outdoors from tubing holes 66 are brought together by a band 65 passed through the two engaging claws 62 of the base frame 61 of weathertight cover fixed on the outdoor side of tubing hole 66. Thus, refrigerant pipe 53, drain hose 54 and power line 55 are fixed at positions on the outdoor side of tubing hole 66, the ventilation passage is not closed by these pipes, and the opening of the ventilation passage can be expanded. Subsequently, cover 64 is attached on base frame 61, and wind and rain are prevented from coming into the room through the ventilation passage.

Seventh Embodiment

Figure 23:
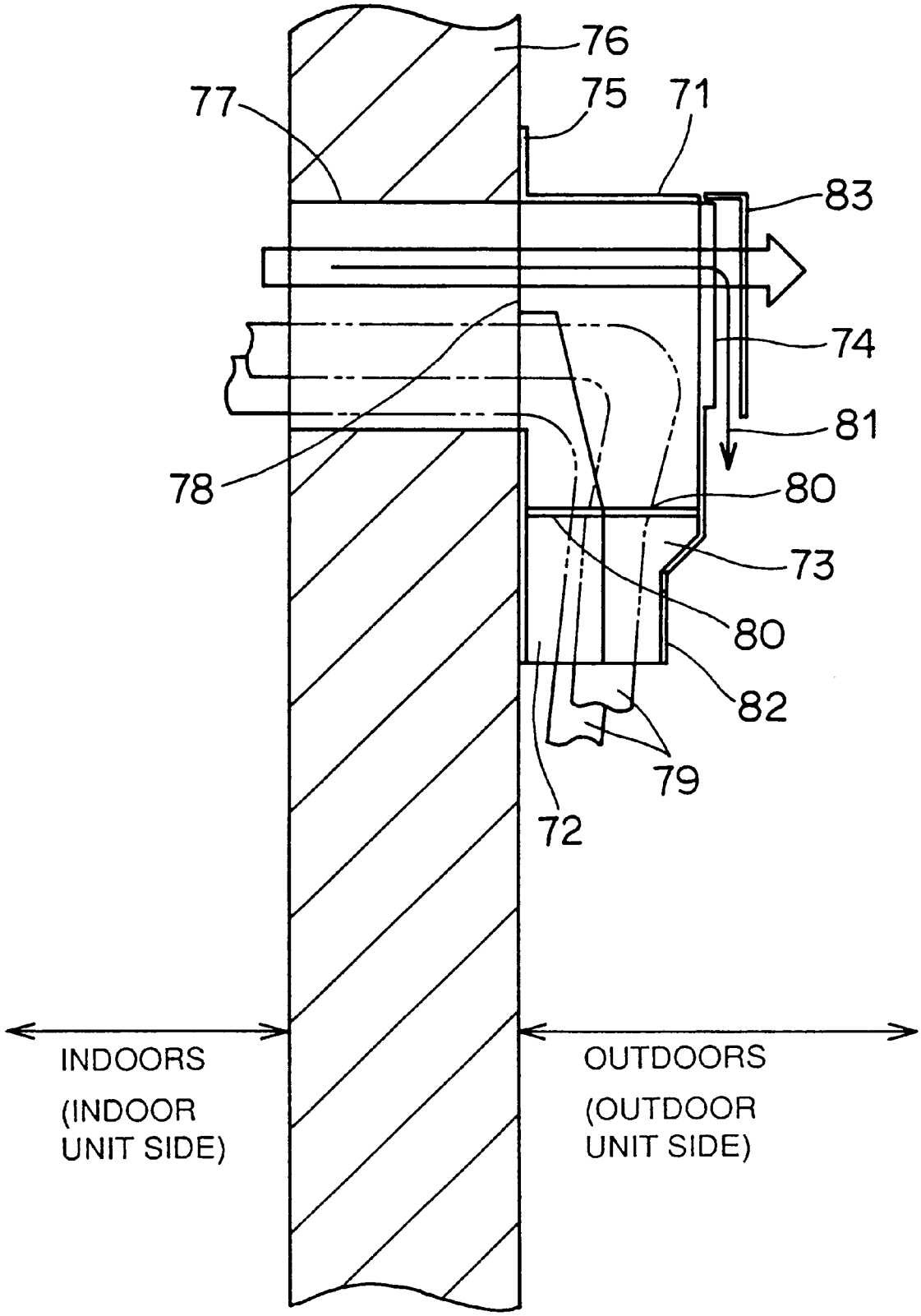
FIG. 23 is a cross sectional view showing a main portion of a tubing cover for an air conditioner according to a seventh embodiment of the invention.

In a seventh embodiment, there is provided an improved tubing cover for integrally covering and protecting bent portions of a power line and pipes connecting the indoor unit and outdoor unit of an air conditioner. FIG. 23 is a cross sectional view showing a main portion of the tubing cover for the air conditioner according to the seventh embodiment. In FIG. 23, a pipe group 79 including a refrigerant pipe and a drainage pipe is inserted from the indoor unit side through a tubing hole 77 previously provided and penetrating through a wall 76 separating the indoors and outdoors. At the time, pipe group 79 is bent as shown to run along wall 76 in the vicinity of the opening of tubing hole 77 on the outdoor side. The tubing cover according to this embodiment is attached to protect the bent portion, and in a tubular shape to protect by encompassing the path of inserting pipe group 79 as described above and air passages for distribution of air between the outdoors and indoors. The tubing cover has its one end connected and communicating with opening 78 on the outdoor side, and the other end is connected and communicating with another tubing cover along wall 76 which is not shown.

Figure 24:
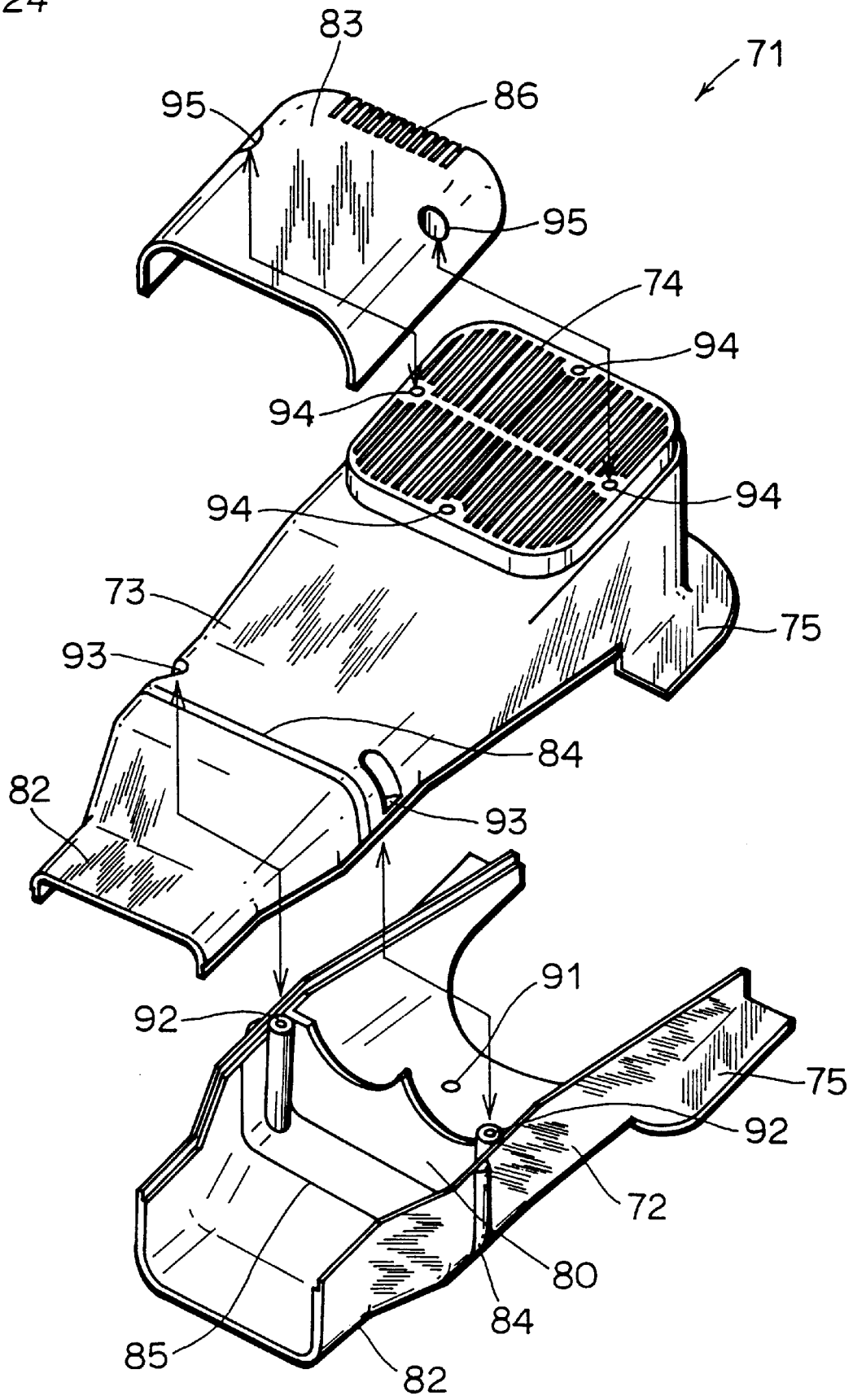
FIG. 24 is an exploded perspective view showing the main portion of the tubing cover in FIG. 23.
Figure 25:
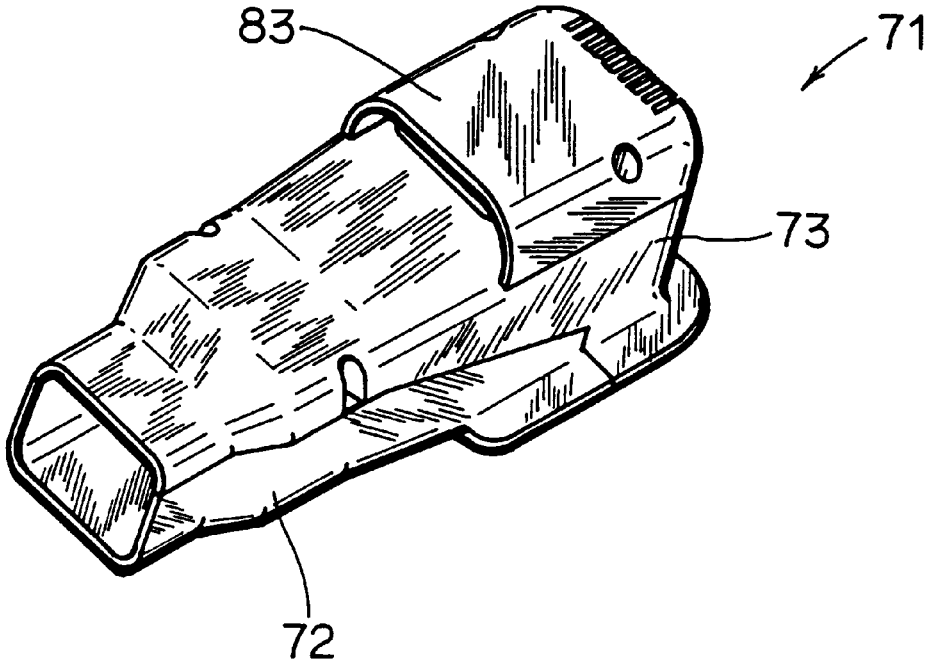
FIG. 25 is a perspective view showing the main portion of the tubing cover in FIG. 23.
Figure 26:
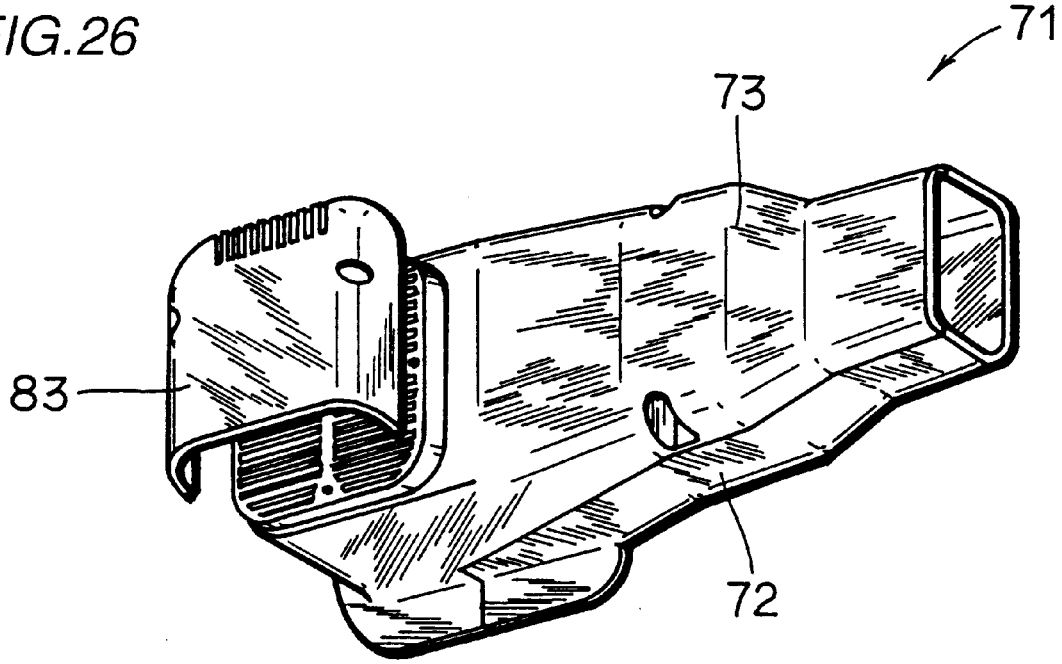
FIG. 26 is a view showing a variation of the tubing cover according to the seventh embodiment of the invention.
Figure 27:
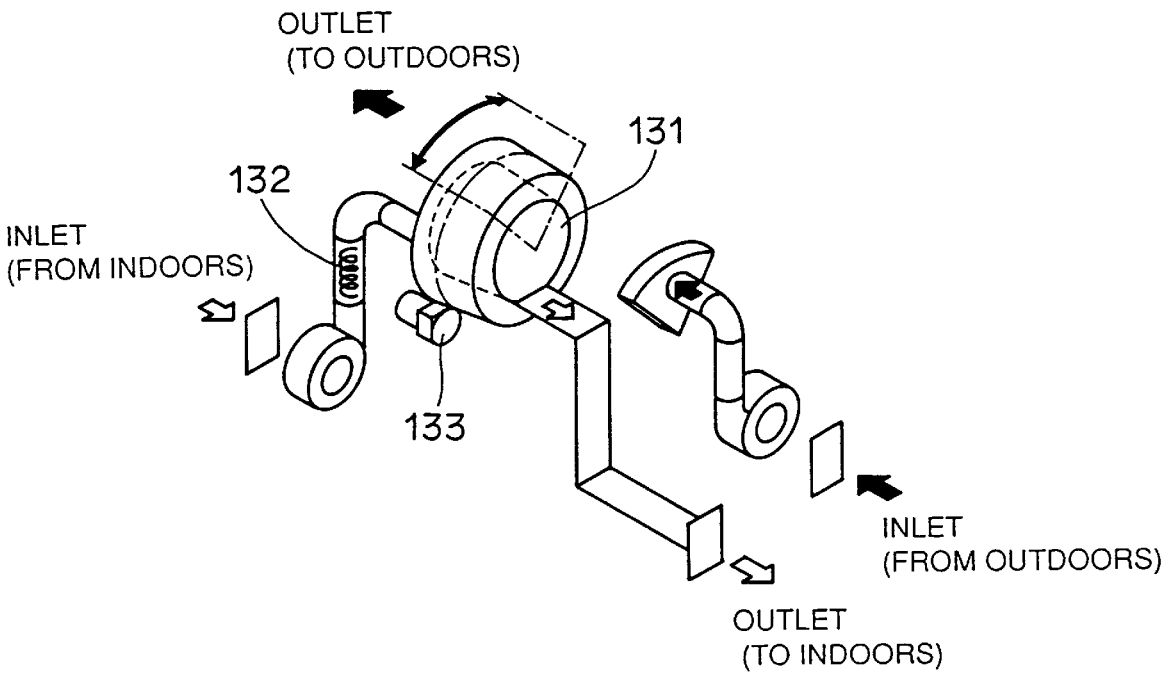
FIG.27 PRIOR ART
FIG. 27 is a view showing the structure of a humidifier disclosed by Japanese Patent Laying-Open No. 63-286634.
Figure 28A:
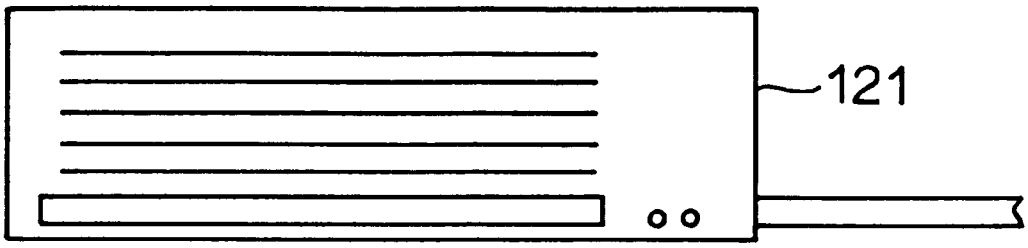
FIG.28A PRIOR ART
FIGS. 28A and 28B are views showing the structure of the indoor unit of a conventional air conditioner.
Figure 28B:
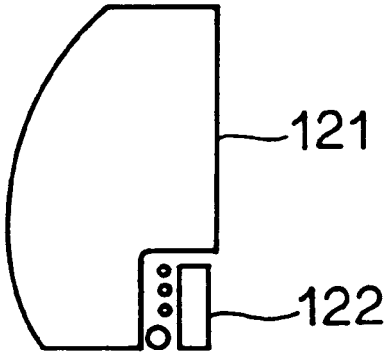
FIG.28B PRIOR ART
Figure 29A:
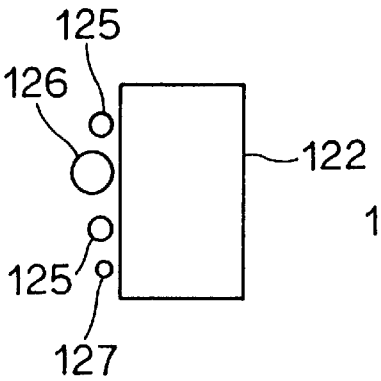
FIG.29A PRIOR ART
FIGS. 29A–29D are enlarged views showing the vicinity of the ventilation duct shown in FIGS. 28A and 28B.
Figure 29B:
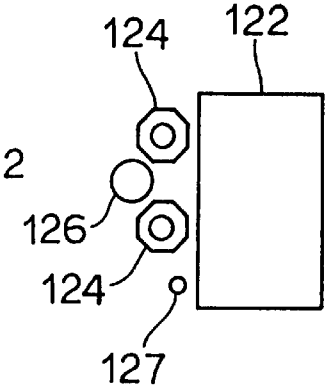
FIG.29B PRIOR ART
Figure 29C:
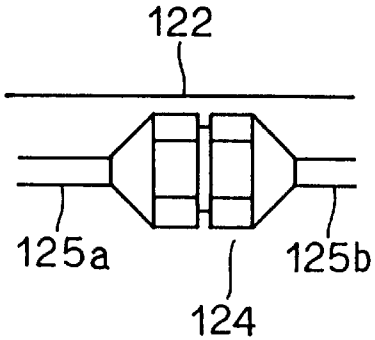
FIG.29C PRIOR ART
Figure 29D:
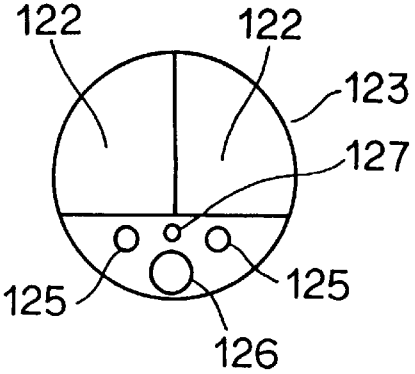
FIG.29D PRIOR ART
Figure 30:
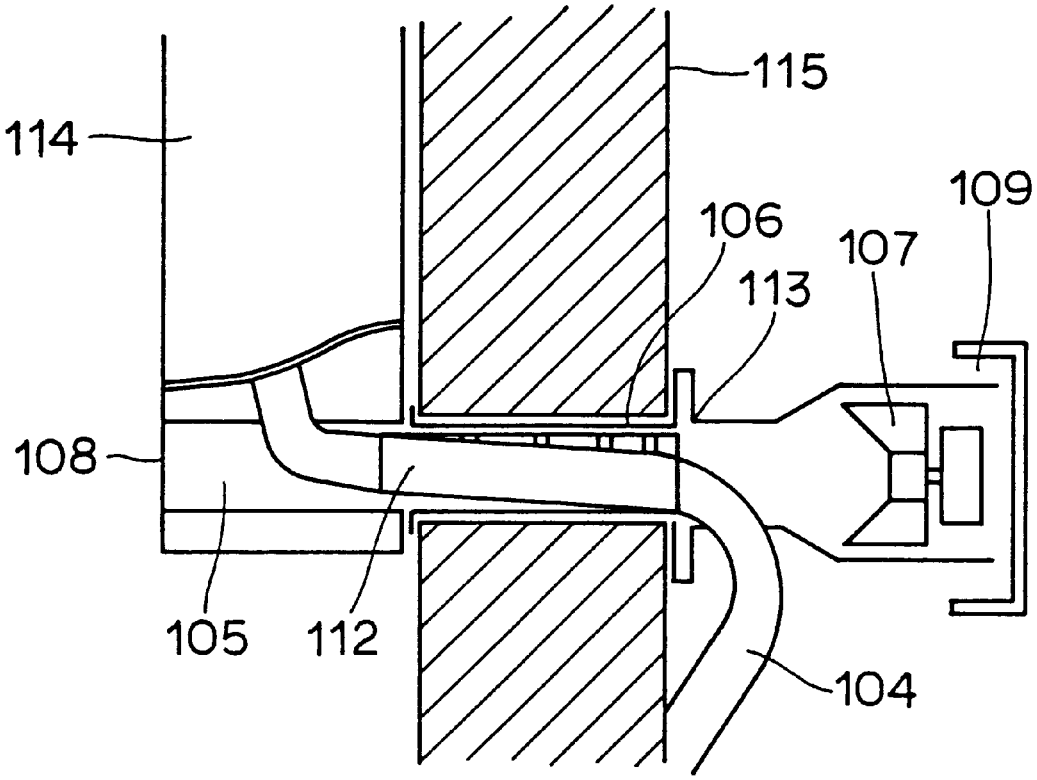
FIG.30 PRIOR ART
FIG. 30 is a cross sectional view showing the vicinity of a ventilation passage in an air conditioner disclosed by Japanese Patent Laying-Open No. 4-73531.
Figure 31A:
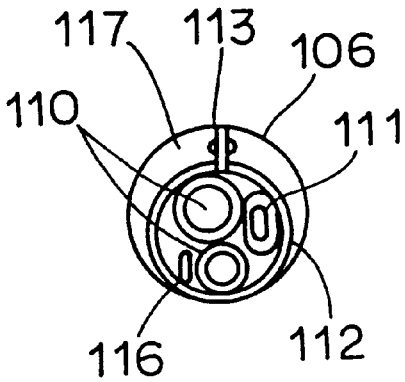
FIG.31A PRIOR ART
FIGS. 31A–31B are cross sectional views showing the ventilation passage shown in FIG. 30.
Figure 31B:
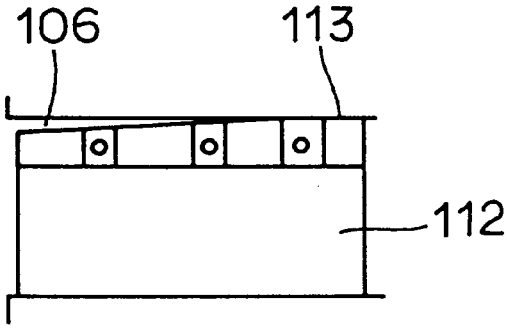
FIG.31B PRIOR ART

FIG. 24 is a perspective view showing a main portion of the tubing cover shown in FIG. 23. FIG. 25 is a perspective view showing a main portion of the tubing cover shown in FIG. 23. FIG. 26 is a view showing a variation of the tubing cover according to the seventh embodiment of the invention.

Referring to FIGS. 23 and 24, cover 71 for the bent portion of pipe group 79 is molded by rigid resin such as polyethylene is separated into two portions, i.e., a lower cover 72 and an upper cover 73 for the ease of attaching work, and a ventilation opening 74 for the flow of air is provided at upper cover 73. Since upper cover 72 and lower cover 73 are provided with a flange 75, tubing cover 71 can be attached in close contact to wall 76 while securing opening portion 78 in tubing hole 77 in wall 76. When pipe group 79 including a refrigerant pipe coupled between the indoor and outdoor side is inserted, the remaining space of tubing hole 77 after pipe group 79 is inserted functions as a passage for distribution of air between the indoors and outdoors. Lower cover 72 or upper cover 73 is provided with a tubing stopper 80 between ventilation opening 74 and connecting portion 82 at the end of cover 71. Pipe group 79 drawn out from opening 78 and bent to run along wall 76 is fixed inside tubing cover 71 by tubing stopper 80. Referring to arrow 81, tubing stopper 80 also functions to send air from the indoors through the air passage to the outdoors mainly through ventilation opening 74 at a position relative to opening 78 and weathertight cover 83. More specifically, it functions as a partition to prevent air from being distributed to other portions. Note that weathertight cover 83 is provided to prevent wind or rain from coming toward the indoor direction through the inside of tubing cover 71 and tubing hole 77.

Tubing cover 71 at the corner portion is connected in communication with another tubing cover (not shown) running along wall 76, and a thick diameter portion and a thin diameter portion are provided stepwise toward the tip end at connecting portion 82 so that tubing cover 71 can be connected with that another tubing cover if their diameters or sizes are different. If that another tubing cover connected to tubing cover 71 has a larger diameter, the thin diameter portion of connecting portion 82 is previously cut away or broken for removal.

When tubing cover 71 is used, pipe group 79 is passed through tubing hole 77, and then lower cover 72 is screwed and secured to wall 76 correspondingly to opening portion 78 from the lower side. Then, pipe group 79 is pressed and bent downwardly to be fixed by tubing stopper 80 provided at lower cover 72. Then, upper cover 73 is engaged with lower cover 72 and the flange 75 of upper cover 73 is screwed and tightly secured to wall 76, while pipe group 79 is pressed to be fixed by tubing stopper 80 of upper cover 73. Lower and upper covers 72 and 73 are divided from the position of opening 78 toward connecting portion 82, but they may be divided from a position in the upper portion of upper cover 73 toward connecting portion 82. In any state of dividing, lower cover 72 is secured to wall 76 by a screw, then upper cover 73 is screwed to lower cover 72, or lower cover 72 and upper cover 73 are screwed together and attached on the wall 76.

Tubing cover 71 is formed of lower cover 72, upper cover 73 and a weathertight cover 83 as shown in FIG. 24. When lower cover 72 is attached to wall 76, the flange 75 of lower cover 72 provided along the opening portion 78 of wall 76 as shown in FIG. 23 is brought into close contact with wall 76 together with the bottom surface of lower cover 72 along opening portion 78. Connecting portion 82 having different stepwise diameters is provided with a large diameter connecting portion 84 to connect cover 71 to another big tubing cover near the side of opening portion 78. Large diameter connecting portion 84 has a strip-shaped projection portion as shown in FIG. 24 to indicate its position and enhance its strength. Herein, the projecting portion may be molded as thick as the other molded portion or may be formed thicker. In order to connect tubing cover 71 to another large diameter tubing cover by cutting off or breaking the portion corresponding to the normal or smaller diameter portion of connecting portion 82, large diameter connecting portion 84 is internally provided with a cut out groove 85 to indicate the position to cut and make easier the cutting.

Covers 72 and 73 are provided with tubing stopper 80 in a shape corresponding to the number and the outer diameters of pipes included in pipe group 79, in order to prevent distribution of air and secure pipe group 79. An attachment hole 91 to attach cover 72 to the wall is provided on the bottom of lower cover 72. Lower cover 72 is fixed to wall 76 by a screw using attachment hole 91, then pipe group 79 drawn out from opening portion 78 and bent to run along wall 76 is provided in a fixed manner inside tubing cover 71 by tubing stopper 80. In the vicinity of tubing stopper 80 for lower cover 72, an upper cover attachment hole 92 having a through hole in a boss shape is provided in order to screw upper cover 73 to lower cover 72. If the relation between the diameter of upper cover attachment hole 92, the diameter and length of the screw to attach upper cover 73 to lower cover 72 is appropriately selected, upper cover 73 may be simply attached to lower cover 72 or alternatively upper cover 73 and lower cover 72 may be both fixed to wall 76 by the screw.

In upper cover 73, flange 75 and connecting portion 82 are formed as is with lower cover 72, and large diameter connecting portion 84 including a strip-shaped projecting portion, tubing stopper 80 and cut out groove 85 inside are provided.

Upper cover 73 is provided with a ventilation opening 74 to take in/exhaust air in the air passage of tubing hole 77 at a position relative to the opening portion 78 of tubing hole 77. Ventilation opening 74 includes an integrally molded grid shaped insect protection screen to prevent insects from entering. Upper cover 73 is provided with an upper cover screw secure hole 93 to attach upper cover 73 to lower cover 72 at a position corresponding to upper cover attachment hole 92. A hood shaped weathertight cover 83 is provided to prevent wind and rain from coming inside through ventilation opening 74. A weathertight cover screw secure hole 95 is registered to a weathertight cover attachment hole 94 provided in the vicinity of ventilation opening 74, and covers 83 and 73 are secured together by a screw. Weathertight cover 83 is attached such that air passing through ventilation opening 74 is directed virtually downwardly if tubing cover 71 is attached in any direction depending upon the direction in which another tubing cover to which it connects is turned. Therefore, a plurality of weathertight cover attachment holes 94 are provided corresponding to positions of weathertight cover screw secure hole 95 as cover 83 turns.

There is provided an integrally molded grid shaped ventilation portion 86 at an upper part of weathertight cover 83. In the case of heavy wind and rain, the pressure of wind blowing from below can be relaxed by ventilating portion 86 to make it flow upwardly so that wind and rain will not enter into the inner side of ventilation opening 74 from the downward position of weathertight cover 83. Ventilating portion 86 is formed only at an upper part of weathertight cover 83 in a grid shape in order to prevent rain from dropping into the inside while relaxing the wind pressure as much as possible. The ventilating portion 86 may be provided in other positions or in other shapes than the shape shown, and the same function can be provided for example if a plurality of small holes are provided at corners in the upper part of weathertight cover 83.

FIG. 25 shows lower cover 72, upper cover 73 and weathertight cover 83 as shown in FIG. 24 in an integral form.

FIG. 26 shows the direction to attach weathertight cover 83 when tubing cover 71 is connected to another tubing cover (not shown) extending in the horizontal direction. At the time, weathertight cover 83 is attached such that air is taken in/exhausted in the downward direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An air conditioner having a humidifying portion for humidifying air in a room, said air conditioner comprising:

a humidifying member having hygroscopicity and gas permeability;

a first air flow passage for taking in air from the room, passing the air through said humidifying member, allowing said humidifying member to absorb moisture included in the air to dry the air, and letting out the air outdoors;

a second air flow passage for taking in said air from said room, passing said air through said humidifying member while heating said air, allowing said moisture absorbed by said humidifying member to evaporate and humidify said air, and letting out said air into said room, said humidifying portion, said first air flow passage, and said second air flow passage forming an indoor unit;

a plurality of pipes passing through a hole formed in a wall to connect said indoor unit and an outdoor unit including a tubing cover; and a ventilation path provided through said hole such that indoor air let out from said indoor unit can be exchanged with outdoor air; said tubing cover encompassing and protecting said plurality of pipes and said ventilation path at an outdoor side end of said hole while partitioning said plurality of pipes and said ventilation path, said tubing cover is provided with a ventilation opening in the vicinity of an air inlet/outlet of said ventilation path, said ventilation opening having a screen to prevent insects from coming into said ventilation path from the outdoors; said tubing cover has a weathertight cover covering said ventilation opening for preventing outdoor wind or rain from coming into said ventilation path from said ventilation opening, and said weathertight cover is attached to said tubing cover such that air passed through said ventilation opening is directed in a predetermined direction regardless of an orientation in which said tubing cover is attached.

2. The air conditioner as recited in claim 1, further comprising a driving portion to rotate said humidifying member so that the absorption of said moisture through said first air flow passage and the evaporation of said moisture through said second air flow passage are continuously performed.

3. The air conditioner as recited in claim 2, further comprising an accommodation portion for accommodating said humidifying member to allow passage of said air therethrough, and a driving force transmitting member for transmitting driving force to rotate said humidifying member from said driving portion to said accommodation portion, said accommodation portion and said driving force transmitting member being integrally formed.

4. The air conditioner as recited in claim 1, further comprising a switching portion provided commonly to said first and second air flow passages for alternately switching letting out of said air passed through said humidifying member to one of said room and said outdoors.

5. The air conditioner as recited in claim 1, further comprising:

wherein said plurality of pipes include a refrigerant pipe and a duct for exchanging indoor air let out from said indoor unit and outdoor air passed through said hole formed in the wall, said refrigerant pipe is formed by coupling first and second pipe portions with a connecting member having a diameter larger than each said pipe portion, and a contact prevention portion for preventing said connecting member and said duct from contacting each other is formed on a surface of said duct opposite to said connecting member when said duct is provided in the vicinity of said refrigerant pipe.

6. The air conditioner as recited in claim 1, further comprising:

a duct having one end connected to said indoor unit, and the other end inserted into the end of said hole on an indoor side for exchanging indoor air let out from said indoor unit and outdoor air, wherein said the other end of said duct has a cross sectional shape in coincidence with the shape of a remaining region in the cross sectional area of said through hole after said number of pipes are passed through.

7. The air conditioner as recited in claim 1, wherein said weathertight cover is provided with a ventilation portion at a position opposite to said predetermined direction to let wind into said weathertight cover.

8. An air conditioner having a humidifying portion for humidifying air in a room, said air conditioner comprising:

a humidifying member having hygroscopicity and gas permeability;

a first air flow passage for taking in air from the room, passing the air through said humidifying member, allowing said humidifying member to absorb moisture included in the air to dry the air, and letting out the air outdoors;

a second air flow passage for taking in said air from said room, passing said air through said humidifying member while heating said air, allowing said moisture absorbed by said humidifying member to evaporate and humidify said air, and letting out said air into said room;

an air intake duct containing said first and second airflow passages;

a first fan;

a second fan;

a motor;

a first exhaust duct containing said first airflow passage, said first exhaust duct being in fluid communication with said first fan;

a second exhaust duct containing said second airflow passage, said second exhaust duct being in fluid communication with said second fan; and a heat exchanger containing said humidifying member, said heat exchanger being in fluid communication with said first and second fans and said air intake duct, said heat exchanger being rotated by said motor, whereby indoor air is substantially humidified without a separate water supply.

9. The air conditioner as recited in claim 8, further comprising a belt coupled to said heat exchanger, said motor further includes a cylindrical gear for driving said belt.

10. The air conditioner as recited in claim 8, further comprising a first gear coupled to said heat exchanger, said motor further includes a second gear for driving said first gear.

11. The air conditioner as recited in claim 8, further comprising a first member having a high friction coefficient adhesively fixed to an outer circumference of said heat exchanger, said motor further includes a second member having a high friction coefficient for driving said second member, said motor further includes mounting springs for adjusting pressure between said first and second members.

12. An air conditioner having a humidifying portion for humidifying air in a room, said air conditioner comprising:

a humidifying member having hygroscopicity and gas permeability;

a first air flow passage for taking in air from the room, passing the air through said humidifying member, allowing said humidifying member to absorb moisture included in the air to dry the air, and letting out the air outdoors;

a second air flow passage for taking in said air from said room, passing said air through said humidifying member while heating said air, allowing said moisture absorbed by said humidifying member to evaporate and humidify said air, and letting out said air into said room;

a fan;

a switching portion provided commonly to said first and second air flow passages for alternately switching letting out of said air passed through said humidifying member to one of said room and outdoors, said switching portion being in fluid communication with said fan;

a first exhaust duct containing said first airflow passage, said first exhaust duct being in fluid communication with said switching portion;

a second exhaust duct containing said second airflow passage, said second exhaust duct being in fluid communication with said switching portion; and a heat exchanger containing said humidifying member, said heat exchanger being in fluid communication with said fan and said air intake duct, whereby indoor air is substantially humidified without a separate water supply.

* * * * *